US012104870B2

(12) United States Patent
Roe et al.

(10) Patent No.: US 12,104,870 B2
(45) Date of Patent: Oct. 1, 2024

(54) QUICK-CONNECT MUZZLE ACCESSORY

(71) Applicant: Shadow Systems LLC, Plano, TX (US)

(72) Inventors: Richard Trevor Simpson Roe, Plano, TX (US); Benjamin Ni Ye, North Richland Hills, TX (US)

(73) Assignee: Shadow Systems LLC, Plano, TX (US)

( * ) Notice: Subject to any disclaimer, the term of this patent is extended or adjusted under 35 U.S.C. 154(b) by 0 days.

(21) Appl. No.: 18/119,658

(22) Filed: Mar. 9, 2023

(65) Prior Publication Data

US 2024/0230267 A1 Jul. 11, 2024

Related U.S. Application Data

(60) Provisional application No. 63/479,454, filed on Jan. 11, 2023.

(51) Int. Cl.
*F41A 21/32* (2006.01)
*F41A 21/36* (2006.01)

(52) U.S. Cl.
CPC ..... *F41A 21/325* (2013.01); *F41A 21/36* (2013.01)

(58) Field of Classification Search
CPC ... F41A 21/36; F41A 21/325; F41A 21/21–42
USPC ..... 89/14.42–14.4, 14.04; 181/223
See application file for complete search history.

(56) References Cited

U.S. PATENT DOCUMENTS 3,978,762 A * 9/1976 Khaidurov ..... F41A 21/36 89/14.3
4,501,189 A 2/1985 Brandl et al.
4,691,614 A * 9/1987 Leffel ..... F41A 21/36 89/14.3

(Continued)

FOREIGN PATENT DOCUMENTS

DE 102005026975 12/2006
DE 102014119738 6/2016

(Continued)

OTHER PUBLICATIONS

Roe, Richard Trevor Simpson; Non-Final Office Action for U.S. Appl. No. 17/680,067, filed Feb. 24, 2022, mailed Jun. 6, 2023, 11 pgs.

(Continued)

*Primary Examiner* — Joshua E Freeman

(57) ABSTRACT

A muzzle accessory assembly is provided. The assembly includes a muzzle accessory having a main body with a proximal end, a distal end, a through-channel extending longitudinally between the proximal end and the distal end, a keyed receptacle within the through-channel, and a slot, and a lock within the slot of the main body, the lock being positionable into an unlocked position and a locked position; and a firearm barrel within the through-channel of the main body, the firearm barrel having a chamber for receiving a firearm round, a firing tube extending distally from the chamber, and a coupling engaging the keyed receptacle of the main body, in which the firearm barrel is removable from the through-channel of the main body when the lock is in the unlocked position, and the firearm barrel is locked longitudinally and rotationally within the through-channel of the main body when the lock is in the locked position.

30 Claims, 23 Drawing Sheets

(56) References Cited

U.S. PATENT DOCUMENTS

| | | | | | |
|---|---|---|---|---|---|
| 4,893,426 | A * | 1/1990 | Bixler | F16B 7/20 | 89/14.05 |
| 5,076,137 | A * | 12/1991 | Paredes | F41A 21/36 | 89/14.3 |
| 5,271,312 | A * | 12/1993 | Lishness | F41A 21/481 | 89/14.05 |
| 5,433,133 | A * | 7/1995 | La France | F41A 21/325 | 89/14.2 |
| 5,479,737 | A | 1/1996 | Osborne et al. | | |
| 5,559,302 | A * | 9/1996 | Latka | F41A 21/325 | 89/14.05 |
| 5,794,374 | A | 8/1998 | Crandall | | |
| 6,450,079 | B1 | 9/2002 | Bourdin et al. | | |
| 7,677,150 | B2 * | 3/2010 | Dater | F41A 21/325 | 89/14.05 |
| 7,748,306 | B1 * | 7/2010 | Curry | F41A 21/38 | 42/1.06 |
| 9,182,187 | B1 | 11/2015 | Griffith | | |
| 9,810,506 | B2 | 11/2017 | Curry | | |
| 9,970,727 | B2 * | 5/2018 | Niswander | F41A 21/34 | |
| 10,480,889 | B1 | 11/2019 | Fan | | |
| 10,767,952 | B1 * | 9/2020 | Till | F41A 21/325 | |
| 10,969,188 | B1 * | 4/2021 | Cottingham | F41A 21/30 | |
| 11,112,201 | B2 | 9/2021 | Warburton | | |
| 11,143,477 | B1 | 10/2021 | Oglesby | | |
| 11,512,917 | B2 * | 11/2022 | Turnblom | F41A 21/325 | |
| 11,874,078 | B2 * | 1/2024 | Roe | F41A 21/325 | |
| 2007/0095198 | A1 * | 5/2007 | Dater | F41A 21/325 | 89/14.3 |
| 2010/0154278 | A1 * | 6/2010 | Curry | F41A 21/36 | 42/107 |
| 2015/0135575 | A1 | 5/2015 | Wood, Jr. et al. | | |
| 2015/0253098 | A1 * | 9/2015 | Russell | F41A 21/30 | 89/14.4 |
| 2019/0101350 | A1 * | 4/2019 | Hall | F41A 21/325 | |
| 2020/0025498 | A1 * | 1/2020 | Wheeler | F41A 21/325 | |
| 2021/0333062 | A1 * | 10/2021 | Kada | F41A 21/325 | |
| 2023/0228515 | A1 * | 7/2023 | Roe | F41A 21/325 | 89/14.05 |
| 2023/0266089 | A1 * | 8/2023 | Krnezic | F41A 21/325 | 89/14.3 |
| 2024/0110758 | A1 | 4/2024 | Roe et al. | | |

FOREIGN PATENT DOCUMENTS

| | | |
|---|---|---|
| EP | 2786087 | 9/2016 |
| WO | 2023137242 | 7/2023 |

OTHER PUBLICATIONS

Roe, Richard Trevor Simpson; Invitation to Pay Additional Fees and, Where Applicable, Protest Fee for Application No. PCT/US2023/060188 filed Jan. 6, 2023, mailed Apr. 6, 2023, 12 pages.

Roe, Richard Trevor Simpson; Notice of Allowance for U.S. Appl. No. 17/680,067, filed Feb. 24, 2022, mailed Sep. 5, 2023, 16 pgs.

Roe, Richard Trevor Simpson; Issue Notification for U.S. Appl. No. 17/680,067, filed Feb. 24, 2022, mailed Dec. 27, 2023, 2 pgs.

Roe, Richard Trevor Simpson; International Search Report and Written Opinion for Application No. PCT/US2023/060188 filed Jan. 6, 2023, mailed May 30, 2023, 15 pages.

Roe, Richard Trevor Simpson; Extended European Search Report for European Application No. 23220101.2 filed Dec. 22, 2023, mailed May 22, 2024, 8 pages.

Roe, Richard Trevor Simpson; International Preliminary Report on Patentability for Application No. PCT/ US2023/060188 filed Jan. 6, 2023, mailed Jul. 25, 2024, 11 pages.

* cited by examiner

QUICK-CONNECT MUZZLE ACCESSORY

CROSS-REFERENCE

This application claims the benefit of U.S. Provisional Patent Application No. 63/479,454, filed on Jan. 11, 2023, the entire contents of which are expressly incorporated herein by reference.

BACKGROUND OF THE INVENTION

It is common to attach different types of muzzle accessories to the barrel of a firearm, such as, for example, a handgun. One such muzzle accessory is a compensator (or muzzle brake). Compensators typically operate by redirecting a portion of discharge gasses upwardly from the muzzle of a firearm, thereby reducing (or compensating for) unwanted upward motion of the firearm caused by recoil forces. A flash suppressor is another type of muzzle accessory that reduces the visible signature of a firearm by cooling or dispersing hot discharge gases that exit the muzzle. A silencing muzzle accessory (also known as a silencer or suppressor) operates to modify and/or reduce the acoustic amplitude of a gunshot.

Typical methods for attaching muzzle accessories to firearm barrels have proved unsatisfactory. For instance, some muzzle accessories are provided with threaded holes that allow them to be screwed onto threaded barrels using high torque. Shims or crush washers are used to allow for proper alignment of such devices while maintaining adequate torquing force during installation. In other instances, one or more set screws are provided to apply lateral frictional forces to barrels to prevent rotation of muzzle accessories after alignment. These attachment methods, however, require specialized tools and bracing equipment to stabilize firearms during installation or removal of muzzle accessories. They are also time consuming, semi-permanent and may not be suitable in situations requiring frequent removal and/or replacement of muzzle accessories, as new shims/washers, careful alignment and retorquing are required for each installation. Repeated tightening of set screws after each installation may also result in stripping of the set screws and/or damage to barrel threads, rendering them ineffective for subsequent use.

There is thus a need for a muzzle accessory capable of being quickly and reliably aligned and affixed to a firearm without need for specialized bracing and other equipment.

BRIEF SUMMARY OF THE INVENTION

Various embodiments of the present invention provide compact muzzle accessories and muzzle accessory assemblies that are capable of quick and easy alignment, installation and removal with little effort and without need for specialized tools.

In accordance with an exemplary embodiment of the subject disclosure, a muzzle accessory assembly is provided. The assembly includes a muzzle accessory having a main body with a proximal end, a distal end, a through-channel extending longitudinally between the proximal end and the distal end, a keyed receptacle within the through-channel, and a slot, and a lock within the slot of the main body, the lock being positionable into an unlocked position and a locked position; and a firearm barrel within the through-channel of the main body, the firearm barrel having a chamber for receiving a firearm round, a firing tube extending distally from the chamber, and a coupling engaging the keyed receptacle of the main body, in which the firearm barrel is removable from the through-channel of the main body when the lock is in the unlocked position, and the firearm barrel is locked longitudinally within the through-channel of the main body when the lock is in the locked position.

In accordance with an aspect of the subject disclosure, the muzzle accessory further includes a biased detent assembly configured to prevent the lock from being positioned into the unlocked position.

In accordance with another aspect of the subject disclosure, the firearm barrel is locked rotationally with respect to the main body when the lock is in the locked position.

In accordance with still another aspect of the subject disclosure, the lock includes a head having a keyed bore, the keyed bore aligning with the keyed receptacle of the main body when the lock is in the unlocked position.

In accordance with yet another aspect of the subject disclosure, the coupling of the firearm barrel includes a plurality of lugs and the keyed receptacle of the main body includes a plurality of first slots respectively receiving the plurality of lugs.

In accordance with still another aspect of the subject disclosure, the keyed bore of the lock includes a plurality of second slots respectively aligned with the first slots of the keyed receptacle when the lock is in the unlocked position.

In accordance with yet another aspect of the subject disclosure, the lock is rotatable within the main body about a longitudinal axis of rotation, the lock being rotatable between the unlocked position and the locked position.

In accordance with still another aspect of the subject disclosure, the muzzle accessory further includes a pin and the lock further includes a spirally-extending slot having a lower surface and a pin stop, the pin engaging the pin stop in the unlocked position.

In accordance with yet another aspect of the subject disclosure, the lower surface of the spirally-extending slot includes a resting surface, the pin engaging the resting surface when the lock is in the locked position.

In accordance with still another aspect of the subject disclosure, a distance from the axis of rotation to the lower surface of the spirally-extending slot decreases gradually from the pin stop to the resting surface.

In accordance with yet another aspect of the subject disclosure, the pin engages the lower surface of the spirally-extending slot with increasing friction as the lock is rotated from the unlocked position to the locked position.

In accordance with another exemplary embodiment of the subject disclosure, a muzzle accessory is provided for coupling to a firearm barrel, the firearm barrel including a chamber for receiving a firearm round, a firing tube extending distally from the chamber, and a coupling at a distal end of the firing tube, the muzzle accessory including a main body having a proximal end, a distal end, a through-channel extending longitudinally between the proximal end and the distal end, a keyed receptacle within the through-channel positioned to engage the coupling of the firearm barrel when the firearm barrel is inserted into the through-channel, and a slot; and a lock within the slot of the main body, the lock being positionable into an unlocked position to permit insertion of the barrel within the through-channel of the main body, the lock being further positionable into a locked position to prevent removal of the firearm barrel from the main body after the firearm barrel is inserted into the through-channel.

In accordance with still another exemplary embodiment of the subject disclosure, a muzzle accessory is provided for coupling to a firearm barrel, the muzzle accessory including a main body having a proximal end, a distal end, a through-channel extending longitudinally between the proximal end and the distal end, a keyed receptacle within the through-channel, and a slot; and a lock within the slot of the main body, the lock having a keyed bore, the lock being positionable into an unlocked position and a locked position, in which the keyed bore aligns with the keyed receptacle of the main body when the lock is in the unlocked position, and the keyed bore does not align with the keyed receptacle of the main body when the lock is in the locked position.

BRIEF DESCRIPTION OF THE SEVERAL VIEWS OF THE DRAWINGS

The following detailed description of an exemplary embodiment of the subject disclosure will be better understood when read in conjunction with the appended drawings. For the purpose of illustrating the present disclosure, there is shown in the drawings an exemplary embodiment. It should be understood, however, that the subject application is not limited to the precise arrangements and instrumentalities shown.

DETAILED DESCRIPTION OF THE INVENTION

Reference will now be made in detail to an exemplary embodiment of the subject disclosure illustrated in the accompanying drawings. Wherever possible, the same or like reference numbers will be used throughout the drawings to refer to the same or like features. It should be noted that the drawings are in simplified form and are not drawn to precise scale. In reference to the disclosure herein, for purposes of convenience and clarity only, directional terms such as upper, lower, top, bottom, above, below and diagonal, are used with respect to the accompanying drawings. Such directional terms used in conjunction with the following description of the drawings should not be construed to limit the scope of the subject disclosure in any manner not explicitly set forth. Additionally, the term "a," as used in the specification, means "at least one." The terminology includes the words above specifically mentioned, derivatives thereof, and words of similar import.

"About" as used herein when referring to a measurable value such as an amount, a temporal duration, and the like, is meant to encompass variations of ±20%, ±10%, ±5%, ±1%, or ±0.1% from the specified value, as such variations are appropriate.

"Substantially" as used herein shall mean considerable in extent, largely but not wholly that which is specified, or an appropriate variation therefrom as is acceptable within the field of art.

"Exemplary" as used herein shall mean serving as an example.

Throughout the subject application, various aspects thereof can be presented in a range format. It should be understood that the description in range format is merely for convenience and brevity and should not be construed as an inflexible limitation on the scope of the subject disclosure. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 2.7, 3, 4, 5, 5.3, and 6. This applies regardless of the breadth of the range.

Furthermore, the described features, advantages and characteristics of the exemplary embodiments of the subject disclosure may be combined in any suitable manner in one or more exemplary embodiments. One skilled in the relevant art will recognize, in light of the description herein, that the subject disclosure can be practiced without one or more of the specific features or advantages of a particular exemplary embodiment. In other instances, additional features and advantages may be recognized in certain exemplary embodiments that may not be present in all exemplary embodiments of the present disclosure.

Figure 10:
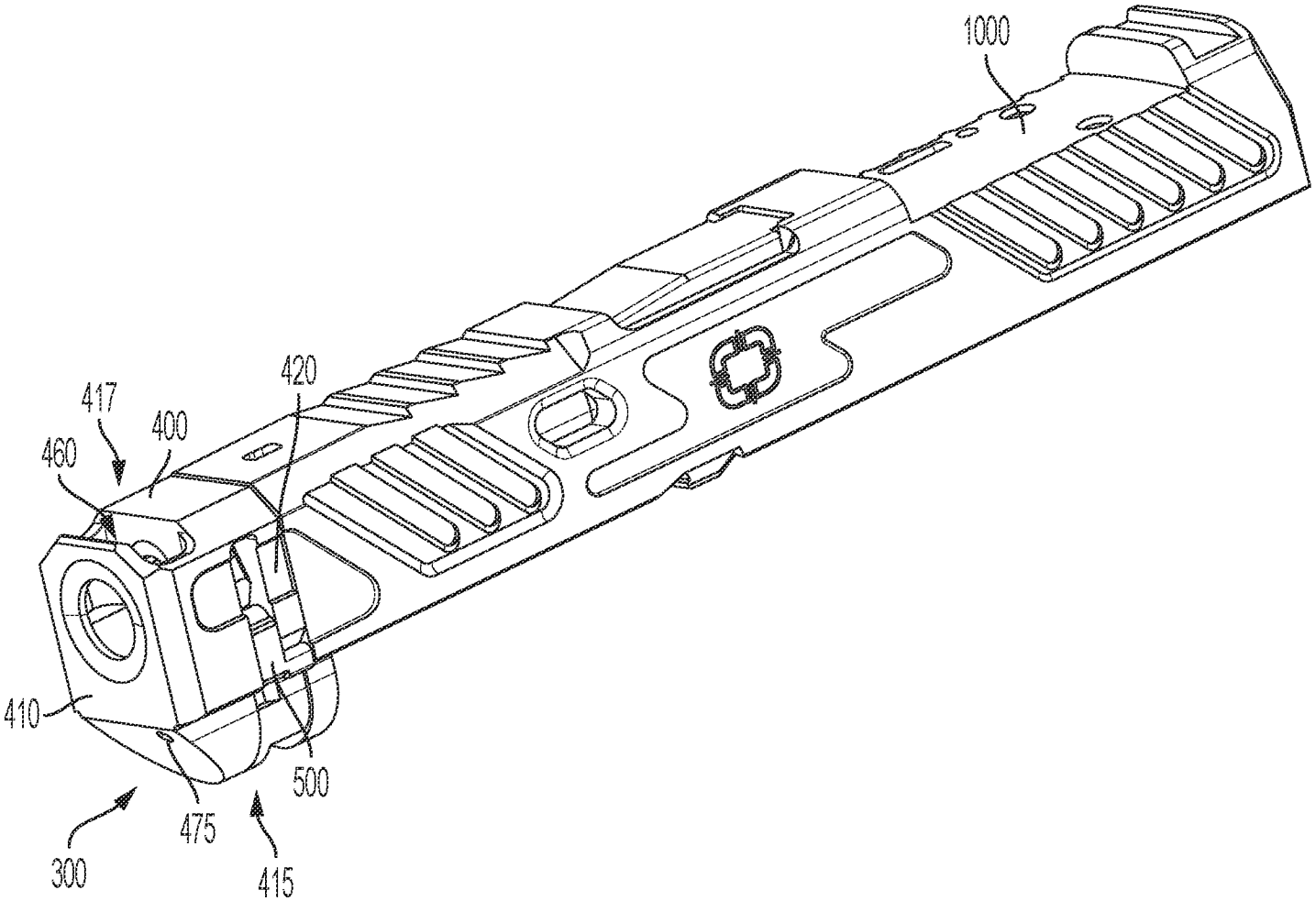
FIG. 10 is a perspective view of the muzzle accessory assembly of FIG. 1 coupled to a handgun slide.
Figure 11:
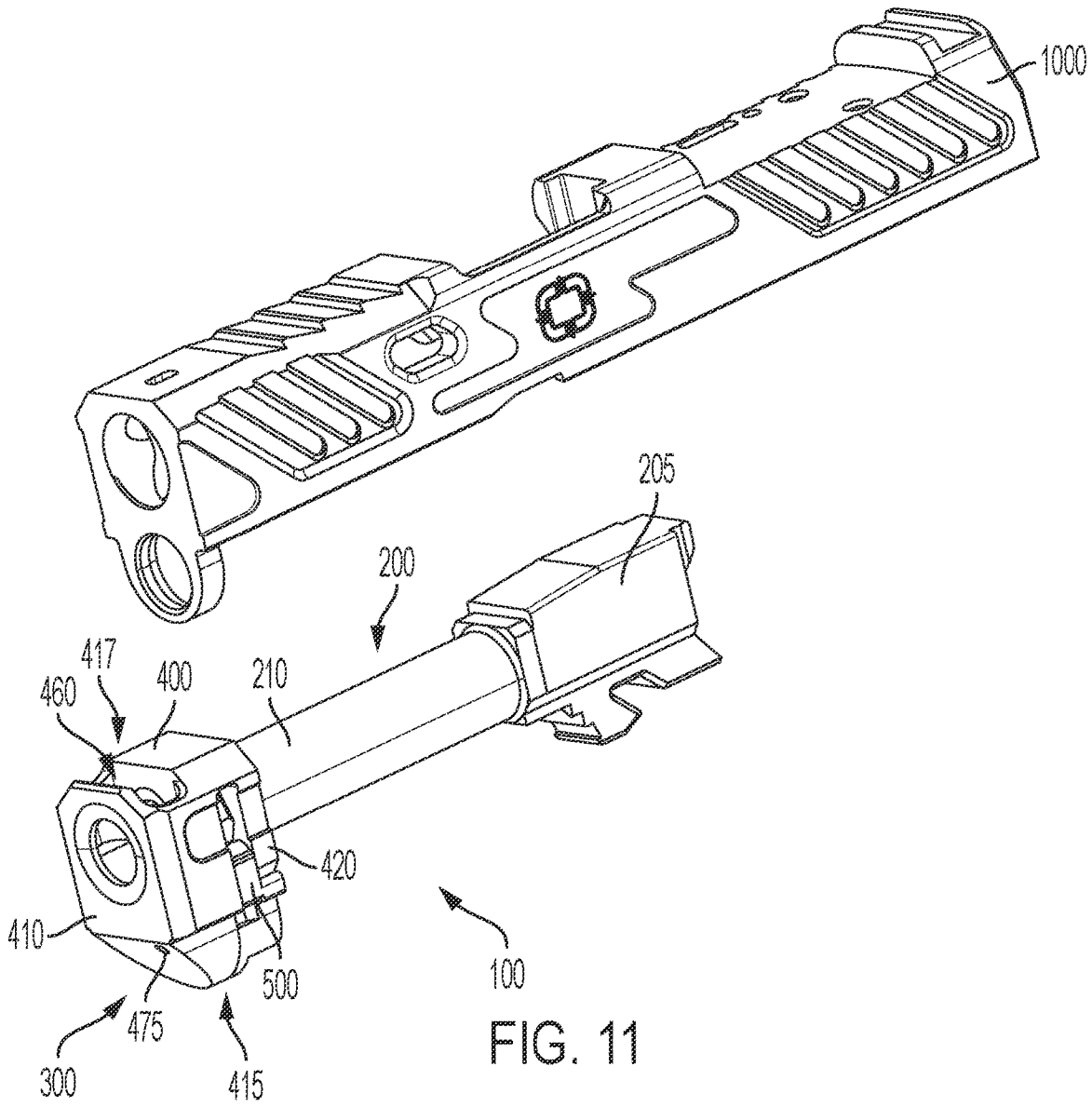
FIG. 11 is an exploded perspective view of the muzzle accessory assembly of FIG. 1 coupled to a handgun slide.
Figure 12:
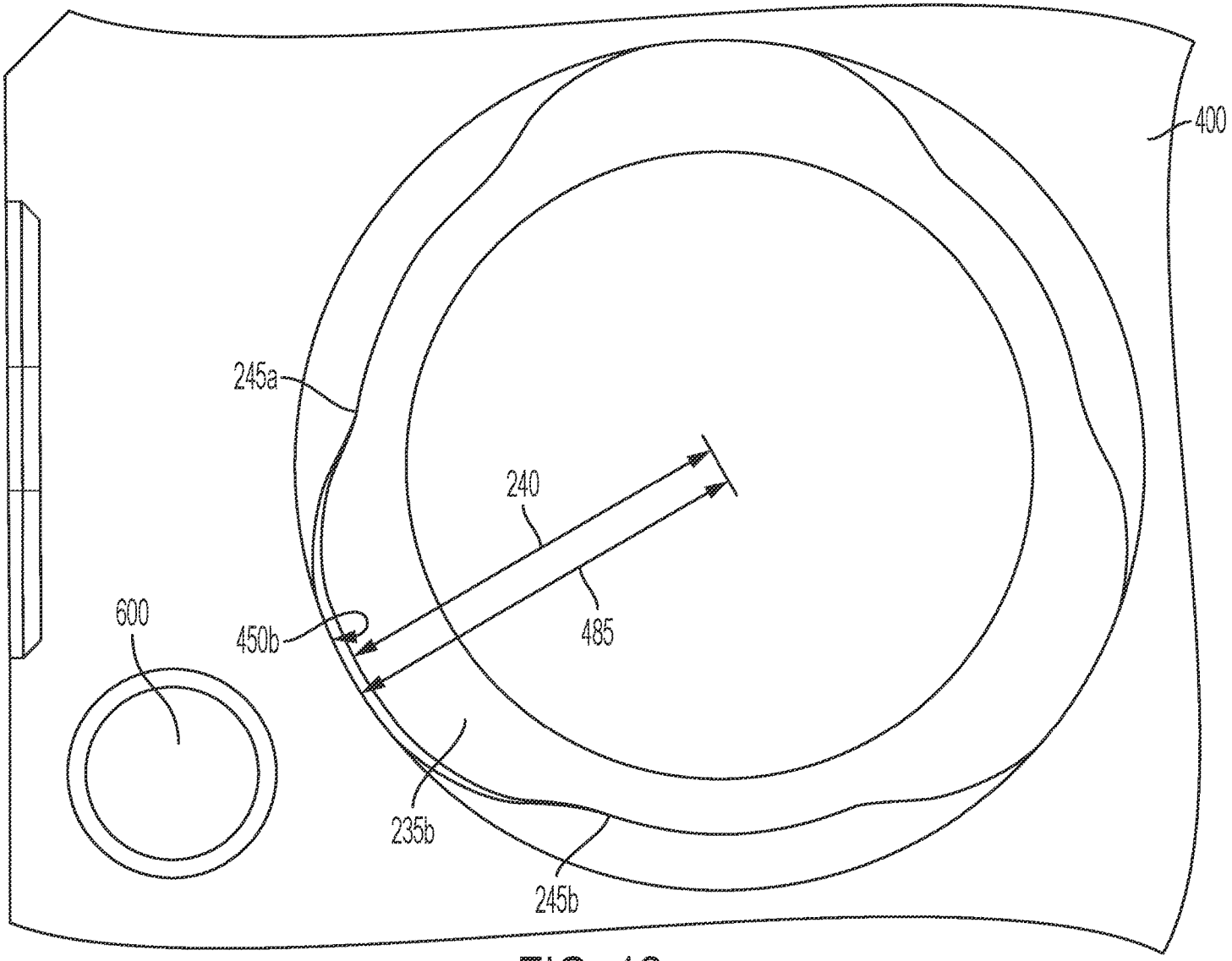
FIG. 12 is a cutaway sectional view of an interface between a barrel lug and a lobe-shaped slot of a main body of the quick-connect muzzle accessory of FIG. 4.
Figure 13:
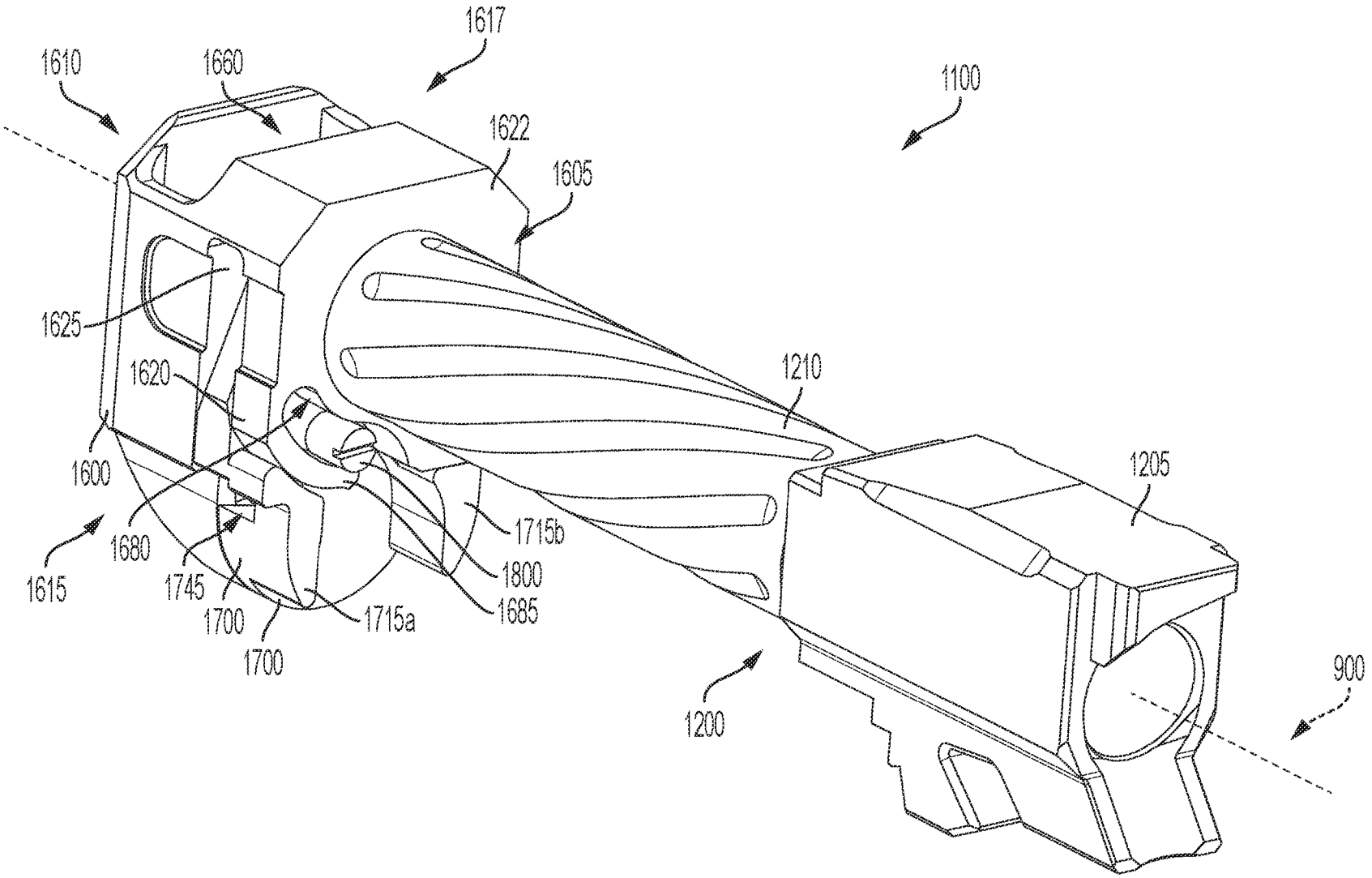
FIG. 13 is a perspective view of another muzzle accessory assembly in accordance with an exemplary embodiment of the subject disclosure.

Referring now to the Figures, there is seen a muzzle accessory assembly 100 in accordance with an exemplary embodiment of the subject disclosure. Muzzle accessory assembly 100 includes a firearm barrel 200 having a proximal chamber 205 for receiving a firearm round and a rifled firing tube 210 extending distally from chamber 205 and having a coupling 215 at a distal end thereof, and a quick-connect muzzle accessory 300 releasably coupled to the distal end of firing tube 210 via coupling 215. In the embodiment depicted in the Figures, barrel 200 is a handgun barrel configured for coupling to a handgun slide 1000 (see FIGS. 10 and 11), though it should be appreciated that barrel 200 and accessory 300 may be shaped and sized differently to fit any type of firearm, such as, for example, a rifle or a shotgun.

Figure 1:
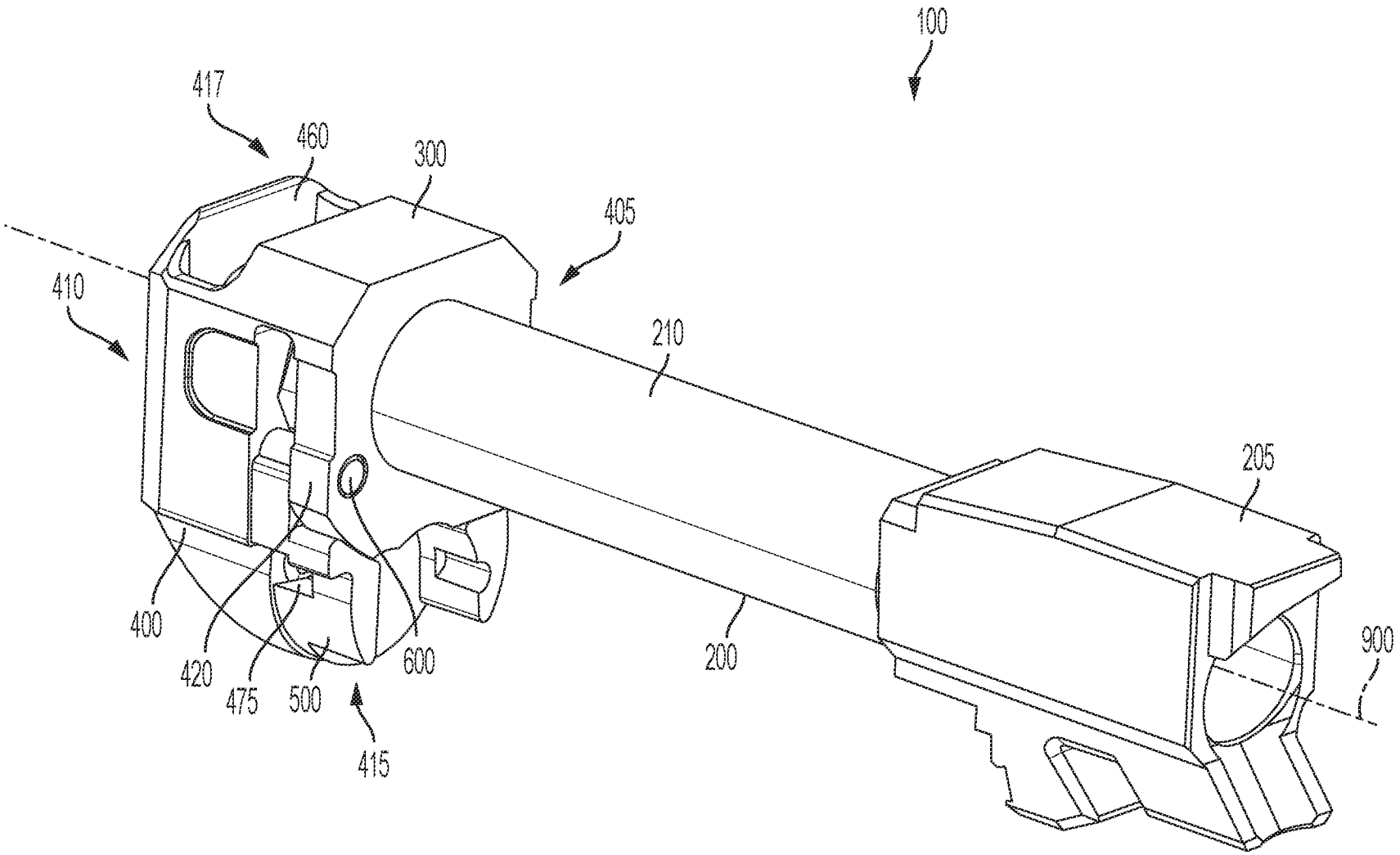
FIG. 1 is a perspective view of muzzle accessory assembly in accordance with an exemplary embodiment of the subject disclosure.
Figure 2:
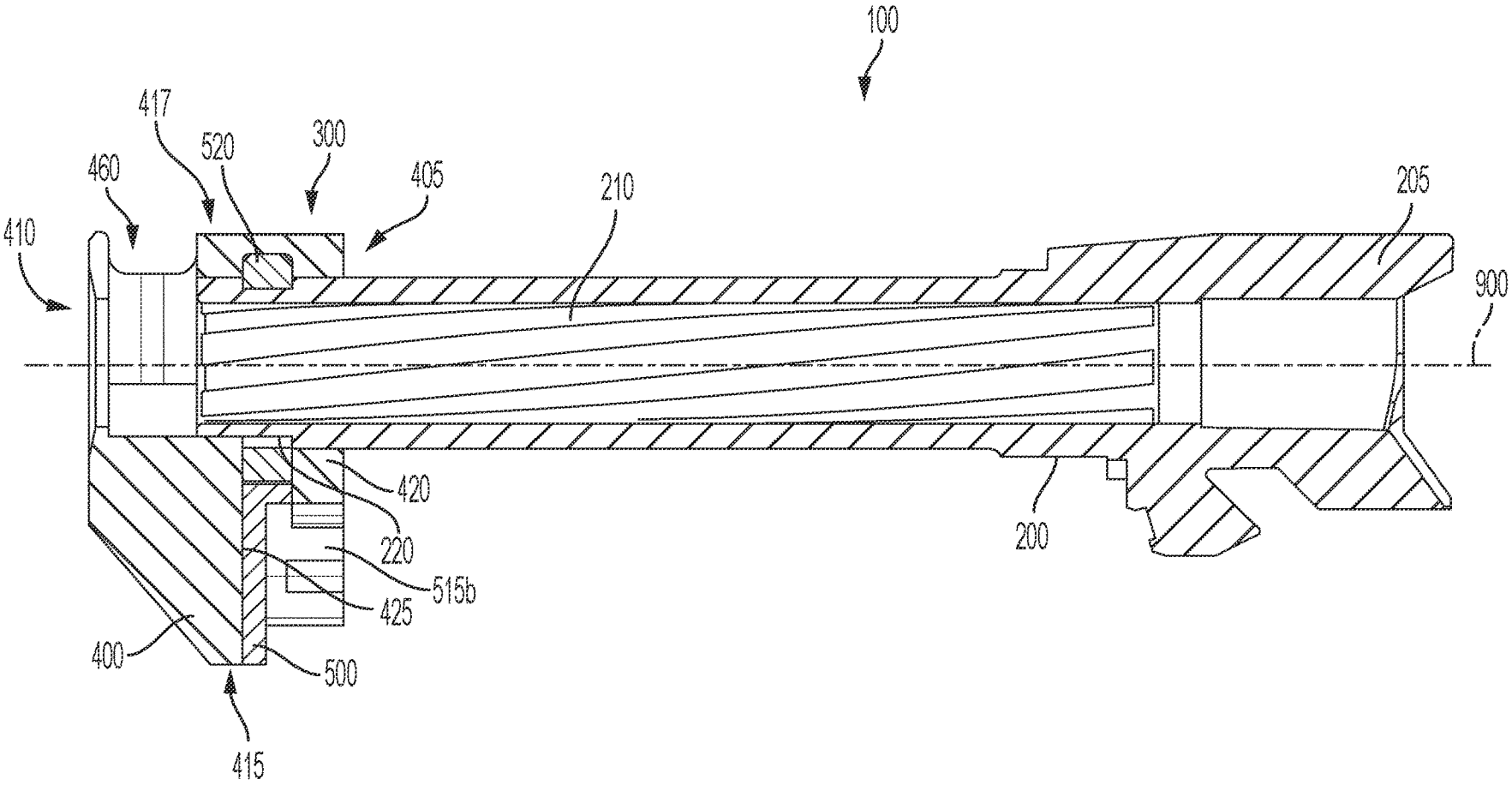
FIG. 2 is a side sectional view of the muzzle accessory assembly of FIG. 1.
Figure 3:
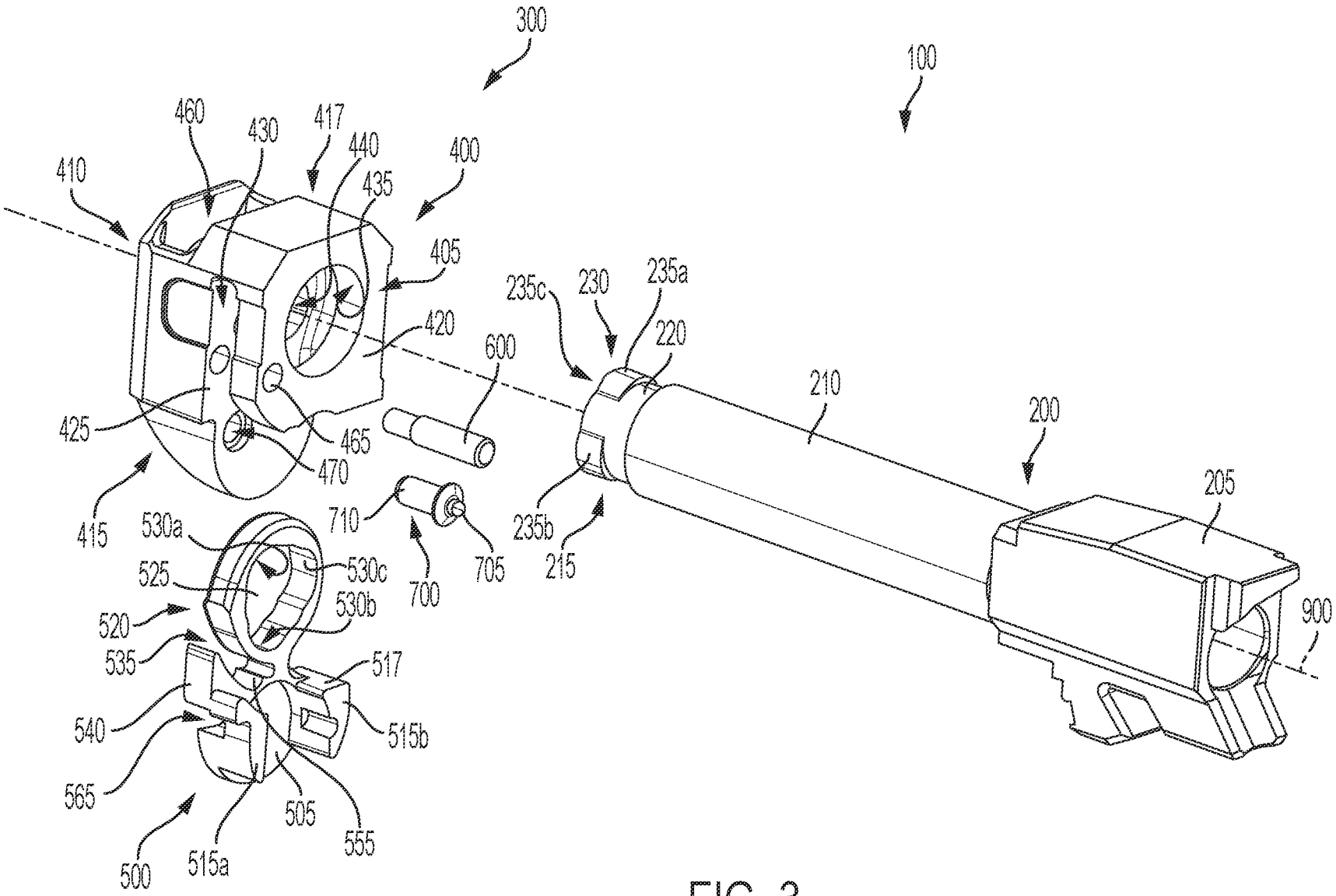
FIG. 3 is an exploded perspective view of the muzzle accessory assembly of FIG. 1.

As best shown in FIG. 3, coupling 215 of barrel 200 includes a key 230 having three radially extending lobe-shaped lugs 235*a*, 235*b*, 235*c* spaced 120 degrees apart circumferentially, and an annular slot 220 proximal of key 230. As described more fully below, key 230 with lugs 235*a*, 235*b*, 235*c* is shaped to mate closely with a corresponding keyed receptacle 445 of quick-connect muzzle accessory 300. For this purpose, it should be appreciated that key 230 of barrel 200 may include more or less than three lugs 235 and lugs 235 may be sized and shaped differently from one another to accommodate a differently sized and shaped keyed receptacle 445. It should also be appreciated that lugs 235 may be spaced at any orientation circumferentially about the outer surface of barrel 200, and that various embodiments of the subject disclosure are not intended to be limited to any particular number, size, shape or circumferential spacing of lugs 235.

As best shown in FIGS. 1 and 3-9, quick-connect muzzle accessory 300 includes a main body 400, a lock 500 slidably positioned within main body 400 and rotatable therein about a longitudinal axis of rotation 900, a pin 600 for guiding limited rotation of lock 500 within main body 400, and a biased stop assembly 700 for preventing inadvertent unlocking of lock 500. In the embodiment depicted in FIGS. 1-12, quick-connect muzzle accessory 300 is a compensator structured to redirect exhaust gasses of a fired round to reduce upward travel of a firearm caused by recoil forces, though it should be appreciated that accessory 300 may include other types of muzzle accessories, such as, for example, flash guards/cones or silencers (also known as suppressors), and that various embodiments of the subject disclosure are not intended to be limited to any particular type of accessory.

Main body 400 of quick-connect muzzle accessory 300 includes a proximal end 405, a distal end 410, a lower end 415, an upper end 417, a proximal wall 420 and a proximally-facing mid-face 425 both formed by a blind slot 430 extending into main body 400 from lower end 415, a bore 435 extending longitudinally through proximal wall 420 for closely receiving the outer surface of firing tube 210 of barrel 200, a through-channel 440 extending longitudinally through main body 400 from mid-face 425 to distal end 410, a keyed receptacle 445 having three radially extending lobe-shaped slots 450*a*, 450*b*, 450*c* spaced 120 degrees apart circumferentially about through-channel 440 for receiving lugs 235*a*, 235*b*, 235*c* of barrel 200, proximally facing stopping surfaces 455*a*, 455*b* positioned within through-channel 440, a transverse and upwardly facing vent 460 communicating with through-channel 440 at distal end 410, a pin receipt bore 465 for fixedly receiving pin 600, a receptacle 470 for receiving biased stop assembly 700, and an access port 475 at distal end 410 and communicating with receptacle 470 for receiving a tool (not shown) to remove biased member 700 proximally from receptacle 470, for example, if biased member 700 breaks or otherwise requires replacement. Although the embodiment depicted in the Figures includes three lobe-shaped slots 450*a*, 450*b*, 450*c* positioned to receive lugs 235*a*, 235*b*, 235*c* of barrel 200, it should be appreciated that any number of slots 450 may be provided to match the number, position, shape and size of lugs 235, and that various embodiments of the subject disclosure are not intended to be limited to any particular number, position, shape or size of slots 450.

Biased stop assembly 700 is press-fit into receptacle 470 and includes a housing 710 and a ball-tip 705 biased proximally by a biasing member (not shown), such as a spring, situated within housing 710. In the event of breakage or other occurrence requiring replacement of biased stop assembly 700, assembly 700 may be removed from main body 400 by inserting the tip of an appropriately sized tool proximally within access port 475 to urge assembly 700 out of receptacle 470. Although biased stop assembly 700 is press-fit into receptacle 470, it should be appreciated that assembly 700 may be maintained within receptacle 470 via other methods, such as, for example, via screw threads, in which case assembly 700 may be removed from main body 400 by unscrewing.

Pin 600 extends through pin receipt bore 465 and across blind slot 430. Pin 600 is maintained fixedly within pin receipt bore 465 via screw threads (not shown), though it should be appreciated that pin 600 may be maintained within bore 465 via other methods, such as, for example, via a press-fit, and that various embodiments of the subject disclosure are not intended to be limited to any particular method for maintaining pin 600 within pin receipt bore 465.

Lock 500 includes a lower body 505 having a laterally directed face 512 and opposed side walls 515*a*, 515*b* (with horizontal stopping surface 517), a disk-shaped head 520 extending upwardly from lower body 505, a keyed bore 525 extending longitudinally through head 520 and having three radially extending lobe-shaped slots 530*a*, 530*b*, 530*c* spaced 120 degrees apart circumferentially for receiving lugs 235*a*, 235*b*, 235*c* of barrel 200, a spirally-extending guide slot 535 forming a biasing tab 540, lower and upper slot surfaces 545, 550, respectively, for receiving pin 600 and a pin stop 555, a resting surface 560 formed in lower slot surface 545, and an access slot 565. Although the embodiment depicted in the Figures shows a lock 500 having three lobe-shaped slots 530*a*, 530*b*, 530*c* positioned to receive lugs 235*a*, 235*b*, 235*c* of barrel 200, it should be appreciated that any number of slots 530 may be provided to match the number, position, shape and size of lugs 235, and that various embodiments of the subject disclosure are not intended to be limited to any particular number, position, shape or size of slots 530.

Figure 4:
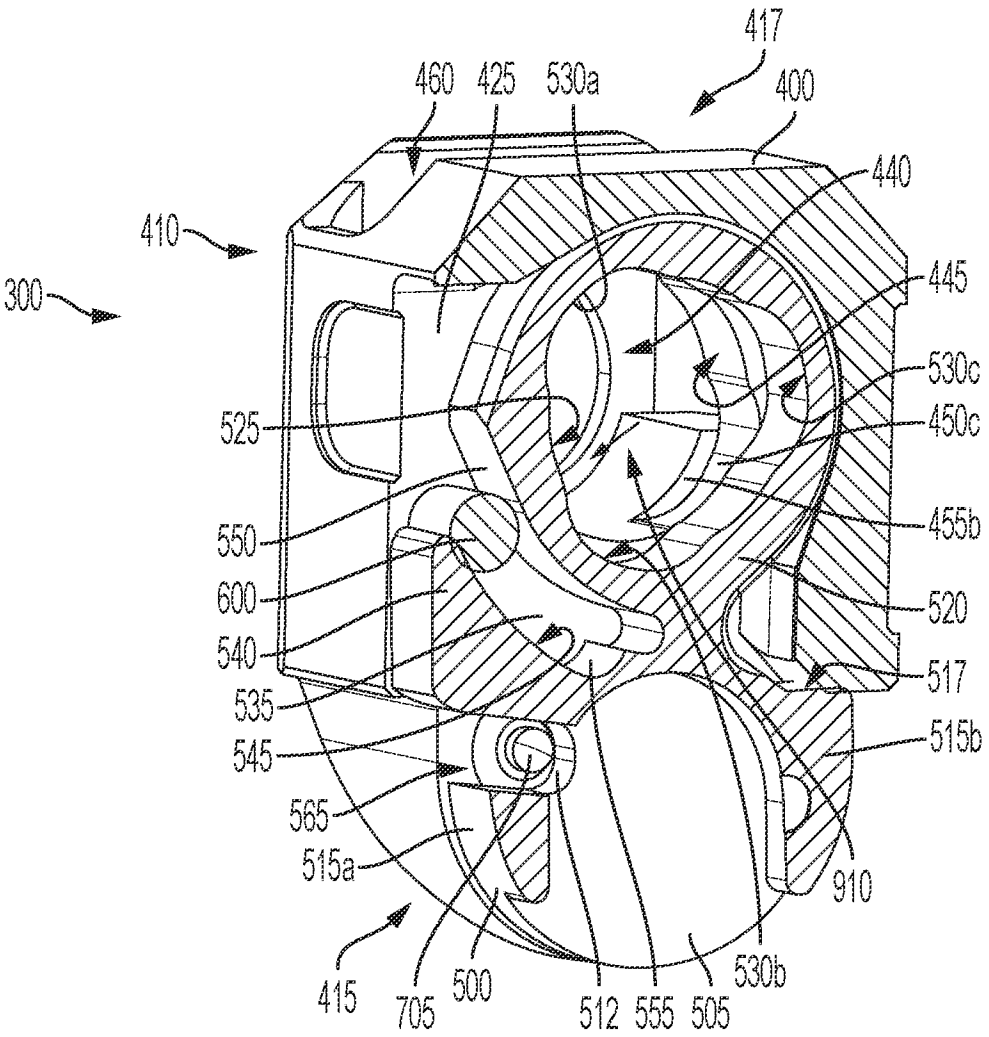
FIG. 4 is a perspective sectional view of a quick-connect muzzle accessory in a locked state, in accordance with an exemplary embodiment of the subject disclosure.
Figure 5:
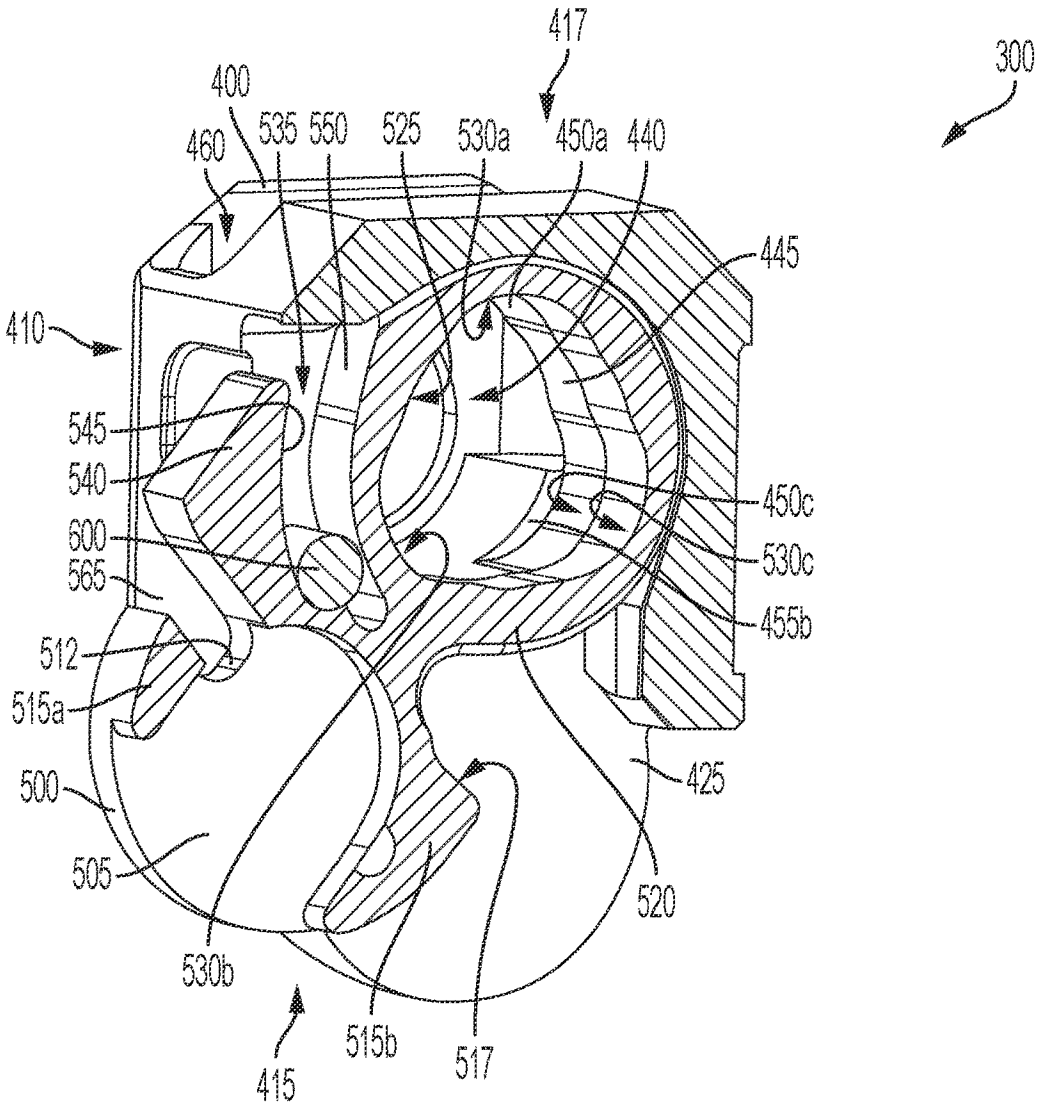
FIG. 5 is a perspective sectional view of the quick-connect muzzle accessory of FIG. 4.

Disk-shaped head 520 of lock 500 is slidably positioned within blind slot 430 of main body 400 and rotatable therein about axis of rotation 900 between an unlocked position, at which pin 600 engages with pin stop 555 (see FIG. 5), and a locked position, at which pin 600 engages with resting surface 560 and stopping surface 517 of side wall 515*b* engages with the lower side of proximal wall 420 to prevent over rotation of lock 500 past the locked position (see FIG. 4). In the unlocked position, lobe-shaped slots 450*a*, 450*b*, 450*c* of main body 400 align with lobe-shaped slots 530*a*, 530*b*, 530*c* of lock 500 to permit insertion of barrel 200 (with correspondingly aligned lobe-shaped lugs 235 of key 230) distally through bore 435 and into through-channel 440 of main body 400. Stopping surfaces 455*a*, 455*b* engage with distally-facing sides of lugs 235*b*, 235*c*, respectively, to prevent over-insertion of barrel 200 and ensure proper longitudinal alignment of barrel 200 with respect to quick-connect muzzle accessory 300. After barrel 200 is fully inserted into main body 400, lock 500 is rotated by hand about axis of rotation 900 to the locked position, thereby causing lobe-shaped slots 530*a*, 530*b*, 530*c* to come out of alignment with slots 450*a*, 450*b*, 450*c* of main body 400. In this position, the distally facing surface of head 520 engages with the proximally facing sides of lugs 235*a*, 235*b*, 235*c* to firmly lock barrel 200 longitudinally within through-channel 440 of main body 400. In the locked position, resting surface 560 engages with pin 600 to maintain lock 500 in the locked position and prevent inadvertent unlocking due to, for example, firearm discharge forces, droppage or entanglement with environmental objects. In the locked position, ball tip 705 of biased stop assembly 700 engages with laterally directed face 512 to provide a secondary mechanism for preventing inadvertent rotation of lock 500 into the unlocked position. It should be appreciated, however, that either or both of resting surface 560 and biased stop assembly 700 may be employed and/or other structures/mechanisms for preventing inadvertent unlocking of lock 500, and that various embodiments of the subject disclosure are not intended to be limited to any particular mechanism(s) for preventing inadvertent unlocking of lock 500.

Figure 6:
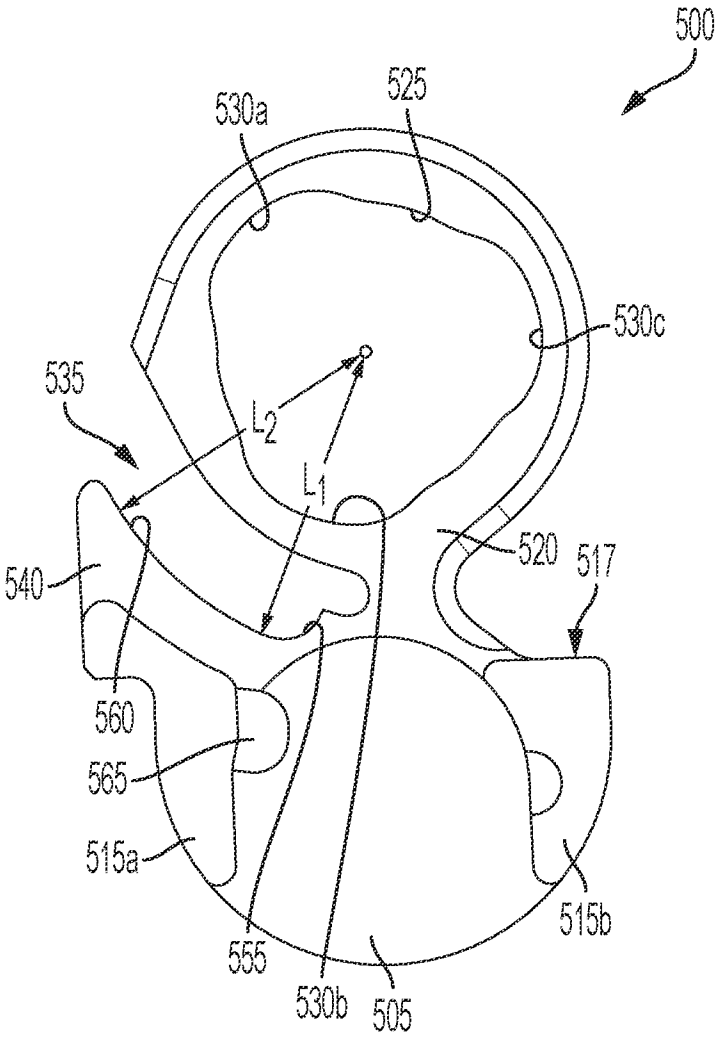
FIG. 6 is a distally-facing view of the proximal end of a lock of the quick-connect muzzle accessory of FIG. 4.
Figure 7:
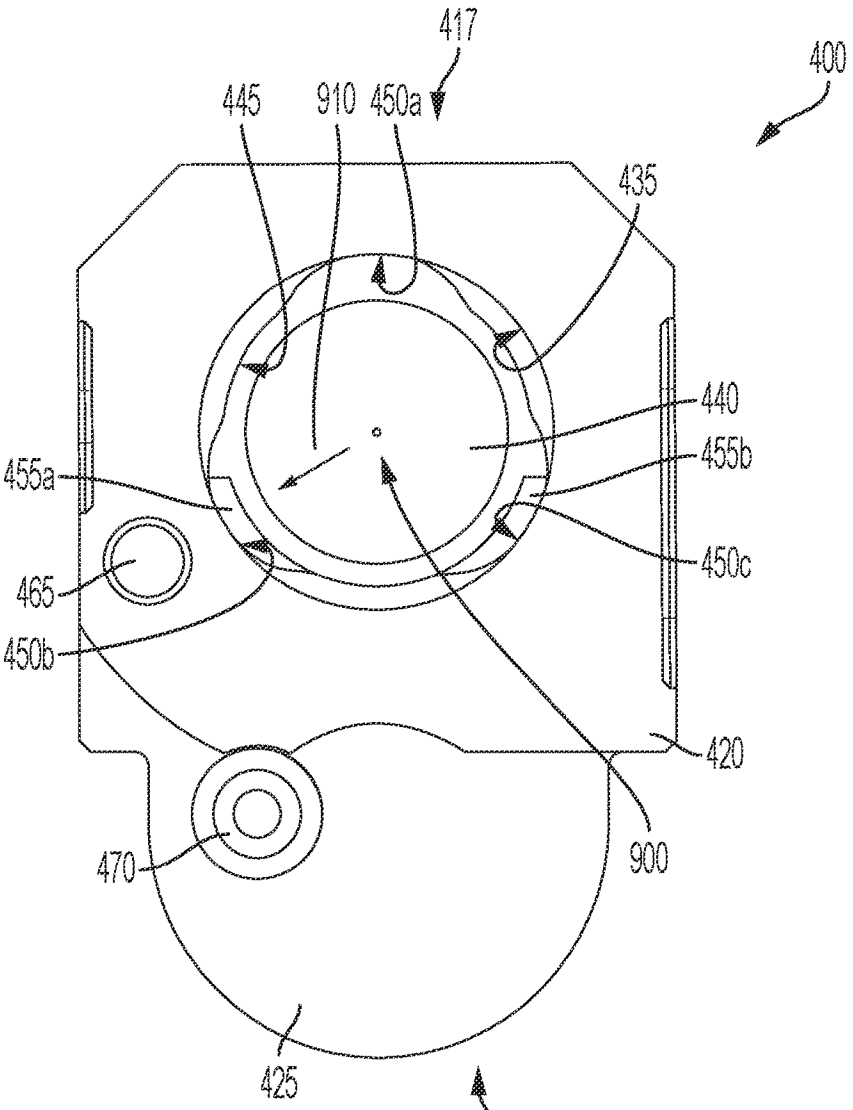
FIG. 7 is a distally-facing view of the proximal end of a main body of the quick-connect muzzle accessory of FIG. 4.
Figure 8:
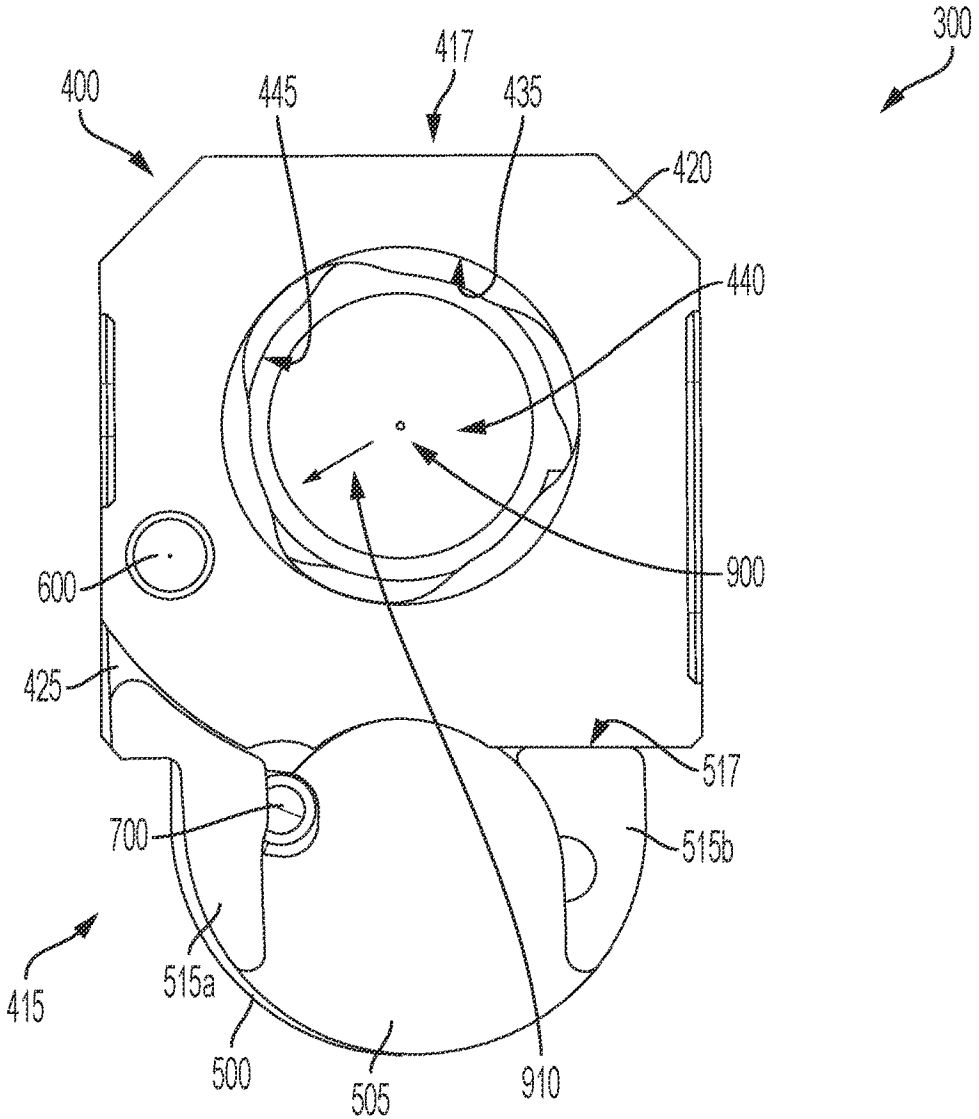
FIG. 8 is a distally-facing view of the proximal end of the quick-connect muzzle accessory of FIG. 4 in a locked state.
Figure 9:
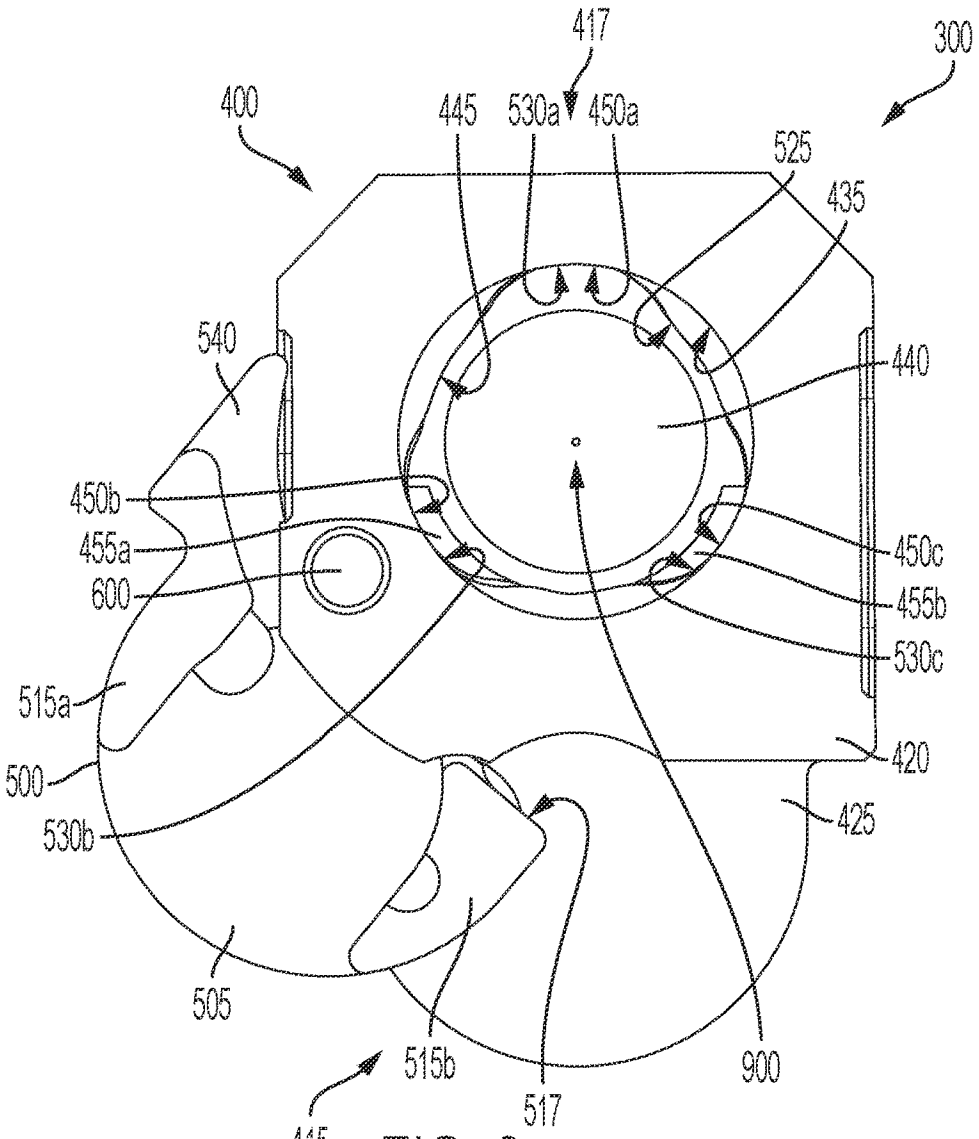
FIG. 9 is a distally-facing view of the proximal end of the quick-connect muzzle accessory of FIG. 4 in an unlocked state.

Spirally-extending guide slot 535 of lock 500 is structured such that a linear distance from axis of rotation 900 to lower slot surface 545 decreases gradually from a distance L1 at a position immediately adjacent pin stop 555 to a distance L2 at resting surface 560 (see FIG. 6). In this manner, as lock 500 is rotated to the locked position, pin 600 engages lower slot surface 545 with increasing friction, causing biasing tab 540 to displace slightly laterally (with greatest lateral displacement occurring in the locked position when pin 600 engages with resting surface 560). This, in turn, causes lock 500 to exert an opposing force on barrel 200 at least partially along direction 910 (see FIGS. 4, 7 and 8), thereby urging lug 235*b* of barrel 200 firmly within lobe-shaped slot 455*b* of main body 400. In this manner, barrel 200 is locked and maintained firmly at the correct rotational orientation via friction, thereby eliminating any rotational play of muzzle accessory 300 about barrel 200 that may result, for example, from design tolerances, wear and tear of contact surfaces, etc. In one embodiment, the height 240 of lug 235*b* is shortened slightly relative to the depth 485 of lobe-shaped slot 450*b* to ensure that lug 235*b* engages with slot 450*b* at inflection points 245*a*, 245*b* when the opposing force is directed on barrel 200 along direction 910 (see FIG. 12). In this manner, rotation of lock 500 into the locked position acts also to self-align muzzle accessory 300 rotationally with respect to barrel 200.

To reduce the amount of force required to rotate lock 500 into the locked position, spirally-extending guide slot 535 may be designed longer, thereby allowing the linear distance from axis of rotation 900 to lower slot surface 545 to decrease more gradually from pin stop 555 to resting surface 560. Though, it should be appreciated that various embodiments of the subject disclosure are not intended to be limited to any particular length of guide slot 535. Furthermore, to better ensure that the opposing force exerted on barrel 200 by lock 500 is directed properly along direction 560 910, resting surface of lock 500 may be oriented perpendicularly to direction 910, though it should be appreciated that various embodiments of the subject disclosure are not intended to be limited to any particular orientation of resting surface 560.

To unlock lock 500, a pin-like tool (not shown) is inserted laterally into access slot 565 until the tip of the tool covers the ball tip 705 of biased stop assembly 700. A distally directed force is then applied by the tool to urge ball tip 705 distally into housing 710 of biased stop assembly 700 until ball tip 705 clears laterally directed face 512 of lock 500. An upwardly directed prying force is then applied to the tool to rotate lock 500 into the unlocked position. With lock 500 in the unlocked position, barrel 200 may be slid and removed proximally from accessory 300.

Referring now to FIGS. 13-18, there is shown another exemplary quick-connect muzzle accessory assembly 1100 in accordance with an exemplary embodiment of the subject disclosure. Muzzle accessory assembly 1100 includes a firearm barrel 1200 having a proximal chamber 1205 for receiving a firearm round and a rifled firing tube 1210 extending distally from chamber 1205 and having a coupling 1215 at a distal end thereof, and a quick-connect muzzle accessory 1500 releasably coupled to the distal end of firing tube 1210 via coupling 1215. In the embodiment depicted in FIGS. 13-18, barrel 1200 is a handgun barrel configured for coupling to handgun slide 1000, though it should be appreciated that barrel 1200 and accessory 1500 may be shaped and sized differently to fit any type of firearm, such as, for example, a rifle or a shotgun.

Figure 14:
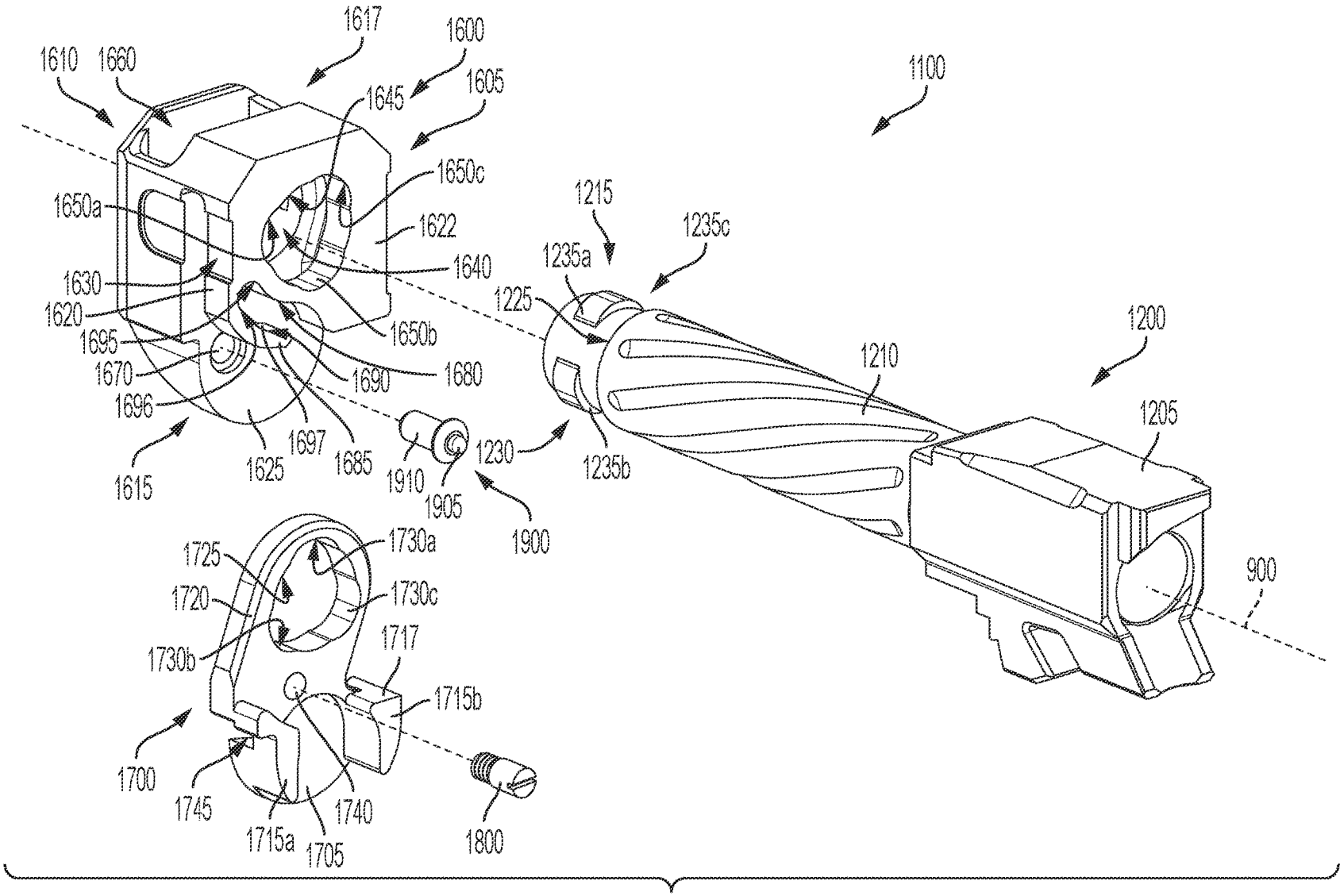
FIG. 14 is an exploded perspective view of the muzzle accessory assembly of FIG. 13.
Figure 15:
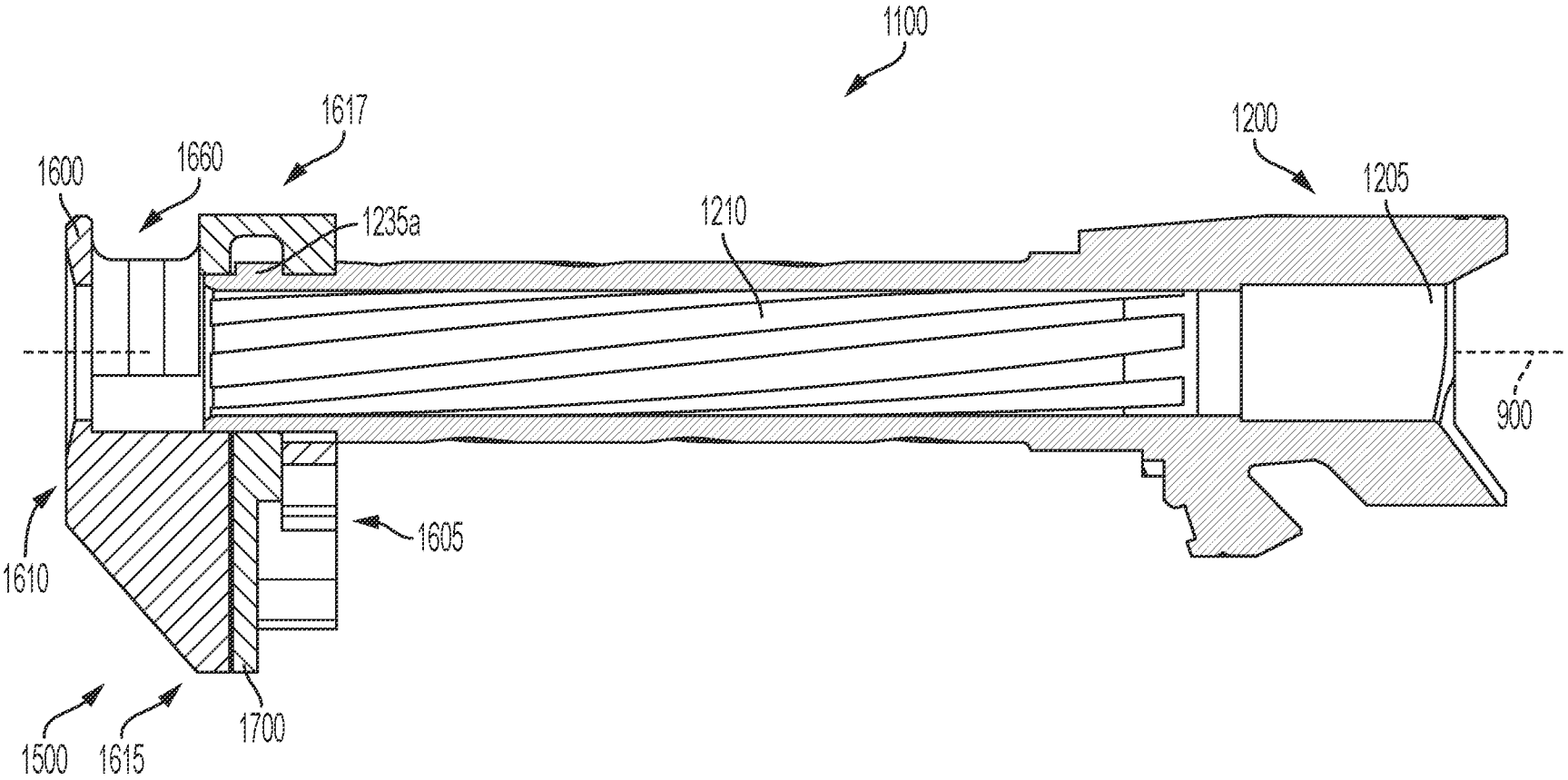
FIG. 15 is a side sectional view of the muzzle accessory assembly of FIG. 13.

As best shown in FIG. 14, coupling 1215 of barrel 1200 includes a key 1230 having three radially extending lobe-shaped lugs 1235*a*, 1235*b*, 1235*c* spaced 120 degrees apart circumferentially, and an annular slot 1220 proximal of key 1230 and forming distally-facing annular face 1225. As described more fully below, key 1230 with lugs 1235*a*, 1235*b*, 1235*c* is shaped to mate closely with a corresponding keyed receptacle 1725 of quick-connect muzzle accessory 1500. For this purpose, it should be appreciated that key 1230 of barrel 1200 may include more or less than three lugs 1235 and lugs 1235 may be sized and shaped differently from one another to accommodate a differently sized and shaped keyed receptacle 1725. It should also be appreciated that lugs 1235 may be spaced at any orientation circumferentially about the outer surface of barrel 1200, and that various embodiments of the subject disclosure are not intended to be limited to any particular number, size, shape or circumferential spacing of lugs 1235.

Quick-connect muzzle accessory 1500 includes a main body 1700, a lock 1600 arranged to rotate with respect to main body 1700 about longitudinal axis of rotation 900, a pin 1800 for guiding limited rotation of lock 1600 with respect to main body 1700, and a biased stop assembly 1900 for preventing inadvertent unlocking of lock 1600. In the embodiment depicted in FIGS. 13-18, quick-connect muzzle accessory 1500 is a compensator structured to redirect exhaust gasses of a fired round to reduce upward travel of a firearm caused by recoil forces, though it should be appreciated that accessory 1500 may include other types of muzzle accessories, such as, for example, flash guards/cones or silencers (also known as suppressors), and that various embodiments of the subject disclosure are not intended to be limited to any particular type of accessory.

Main body 1700 includes a lower body 1705 having a laterally directed face 1712 and opposed side walls 1715*a*, 1715*b* (with horizontal stopping surface 1717), a head 1720 extending upwardly from lower body 1705, a keyed receptacle 1725 extending longitudinally through head 1720 and having three radially extending lobe-shaped slots 1730*a*, 1730*b*, 1730*c* spaced 120 degrees apart circumferentially for receiving lugs 1235*a*, 1235*b*, 1235*c* of barrel 1200, a pin receipt bore 1740 for fixedly receiving pin 1800, and an access slot 1745. Although the embodiment depicted in the Figures shows a main body 1700 having three lobe-shaped slots 1730*a*, 1730*b*, 1730*c* positioned to respectively receive lugs 1235*a*, 1235*b*, 1235*c* of barrel 1200, it should be appreciated that any number of slots 1730 may be provided to match the number, position, shape and size of lugs 1235, and that various embodiments of the subject disclosure are not intended to be limited to any particular number, position, shape or size of slots 1730.

Lock 1600 of quick-connect muzzle accessory 1500 includes a proximal end 1605, a distal end 1610, a lower end 1615, an upper end 1617, a proximal wall 1620 with proximally-facing surface 1622, a proximally-facing mid-face 1625, a blind slot 1630 for receiving head 1720 of main body 1700, a through-channel 1640 extending longitudinally from mid-face 1625 to distal end 1610, a keyed bore 1645 having three radially extending lobe-shaped slots 1650*a*, 1650*b*, 1650*c* spaced 120 degrees apart circumferentially for respectively receiving lugs 1235*a*, 1235*b*, 1235*c* of barrel 1200, a spirally-extending guide slot 1680 forming a biasing tab 1685, lower and upper slot surfaces 1690, respectively, for receiving pin 1800, a pin stop 1696, a resting surface 1697 formed in lower slot surface 1690, a transverse and upwardly facing vent 1660 communicating with through-channel 1640 at distal end 1610, a receptacle 1670 for receiving biased stop assembly 1900, and an access port 1675 at distal end 1610 and communicating with receptacle 1670 for receiving a tool (not shown) to remove biased member 1900 proximally from receptacle 1670, for example, if biased member 1900 breaks or otherwise requires replacement. Although the embodiment depicted in FIGS. 13-18 shows a lock 1600 having three lobe-shaped slots 1650*a*, 1650*b*, 1650*c* positioned to receive lugs 1235*a*, 1235*b*, 1235*c* of barrel 1200, it should be appreciated that any number of slots 1650 may be provided to match the number, position, shape and size of lugs 1235, and that various embodiments of the subject disclosure are not intended to be limited to any particular number, position, shape or size of slots 1650.

Biased stop assembly 1900 is press-fit into receptacle 1670 of lock 1600 and includes a housing 1910 and a ball-tip 1905 biased proximally by a biasing member (not shown), such as a spring, situated within housing 1910. In the event of breakage or other occurrence requiring replacement of biased stop assembly 1900, assembly 1900 may be removed from lock 1600 by inserting the tip of an appropriately sized tool proximally within access port 1675 to urge assembly 1900 out of receptacle 1670. Although biased stop assembly 1900 is press-fit into receptacle 1670, it should be appreciated that assembly 1900 may be maintained within receptacle 1670 via other methods, such as, for example, via screw threads, in which case assembly 1900 may be removed from lock 1600 by unscrewing.

Pin 1800 extends into pin receipt bore 1740 of main body 1700. Pin 1800 is maintained fixedly within pin receipt bore 1740 via screw threads (not shown), though it should be appreciated that pin 1800 may be maintained within bore 1740 via other methods, such as, for example, via a press-fit, and that various embodiments of the subject disclosure are not intended to be limited to any particular method for maintaining pin 1800 within pin receipt bore 1740.

Figure 16:
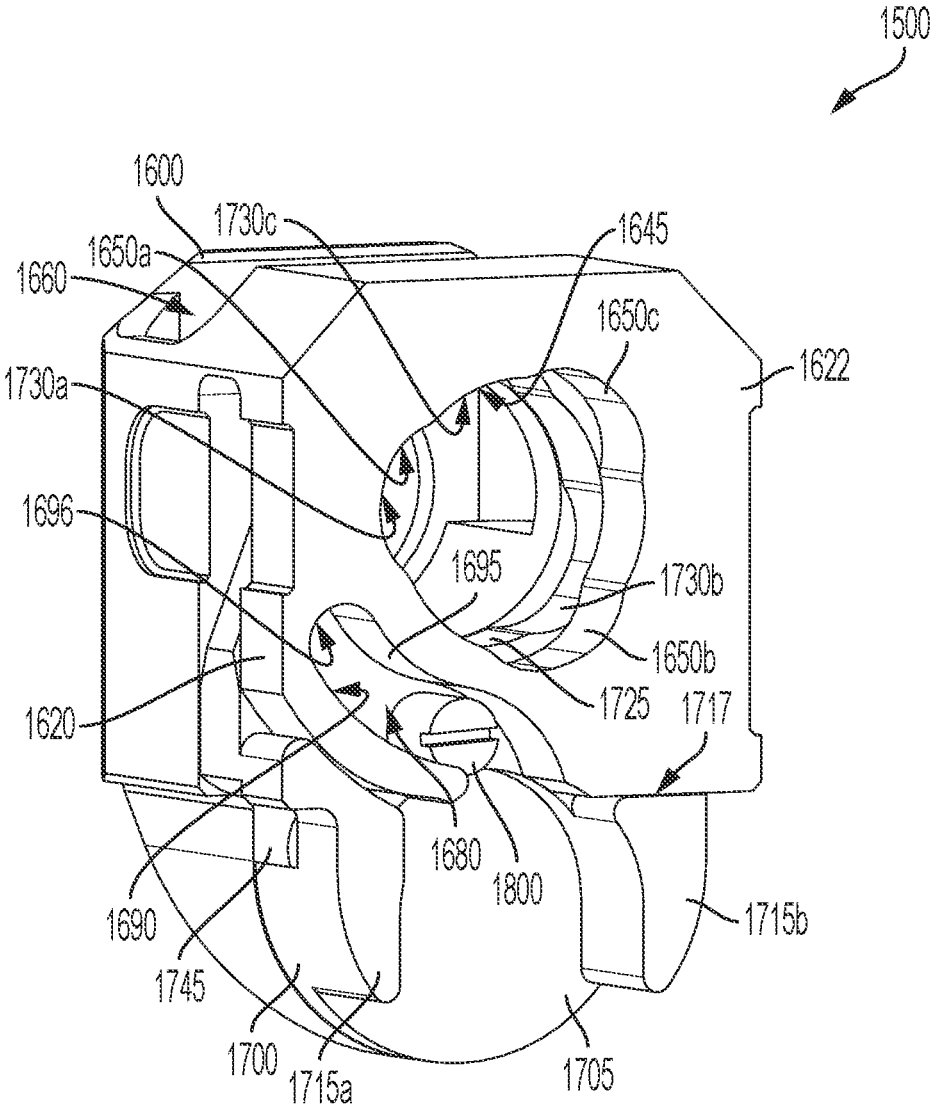
FIG. 16 is perspective view of a muzzle accessory of the muzzle accessory assembly of FIG. 13.
Figure 17:
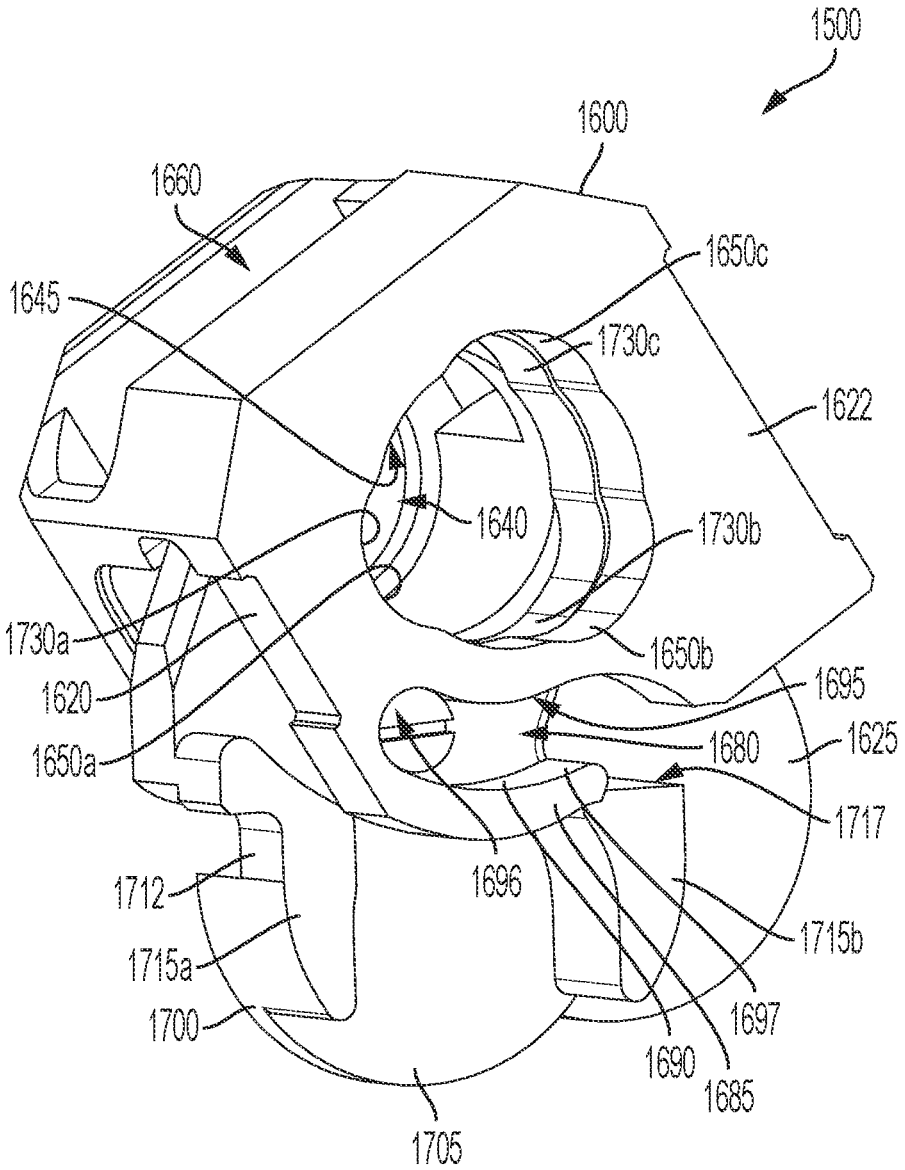
FIG. 17 is perspective view of the muzzle accessory of FIG. 16 in an unlocked position.
Figure 18:
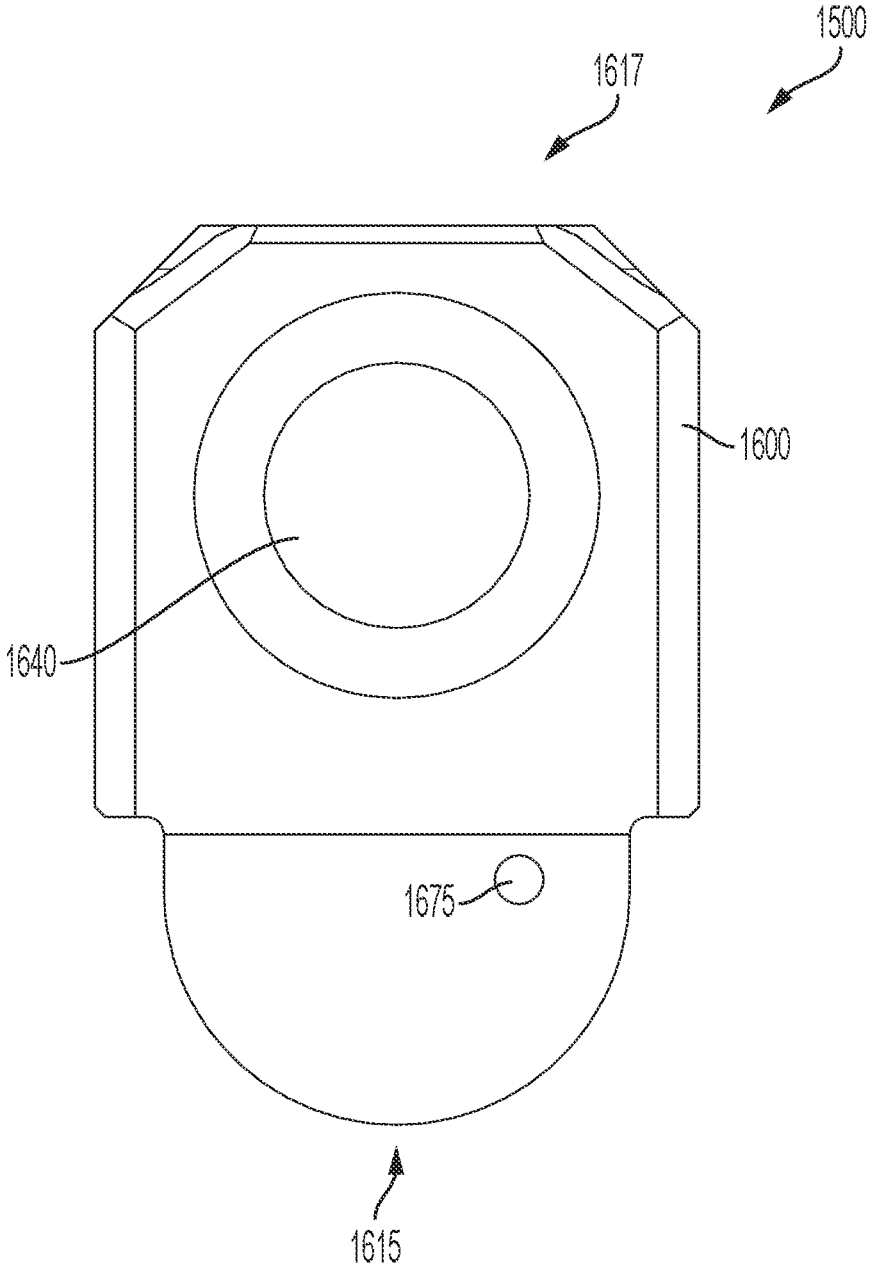
FIG. 18 is distally-facing view of the muzzle accessory of FIG. 16.
Figure 19:
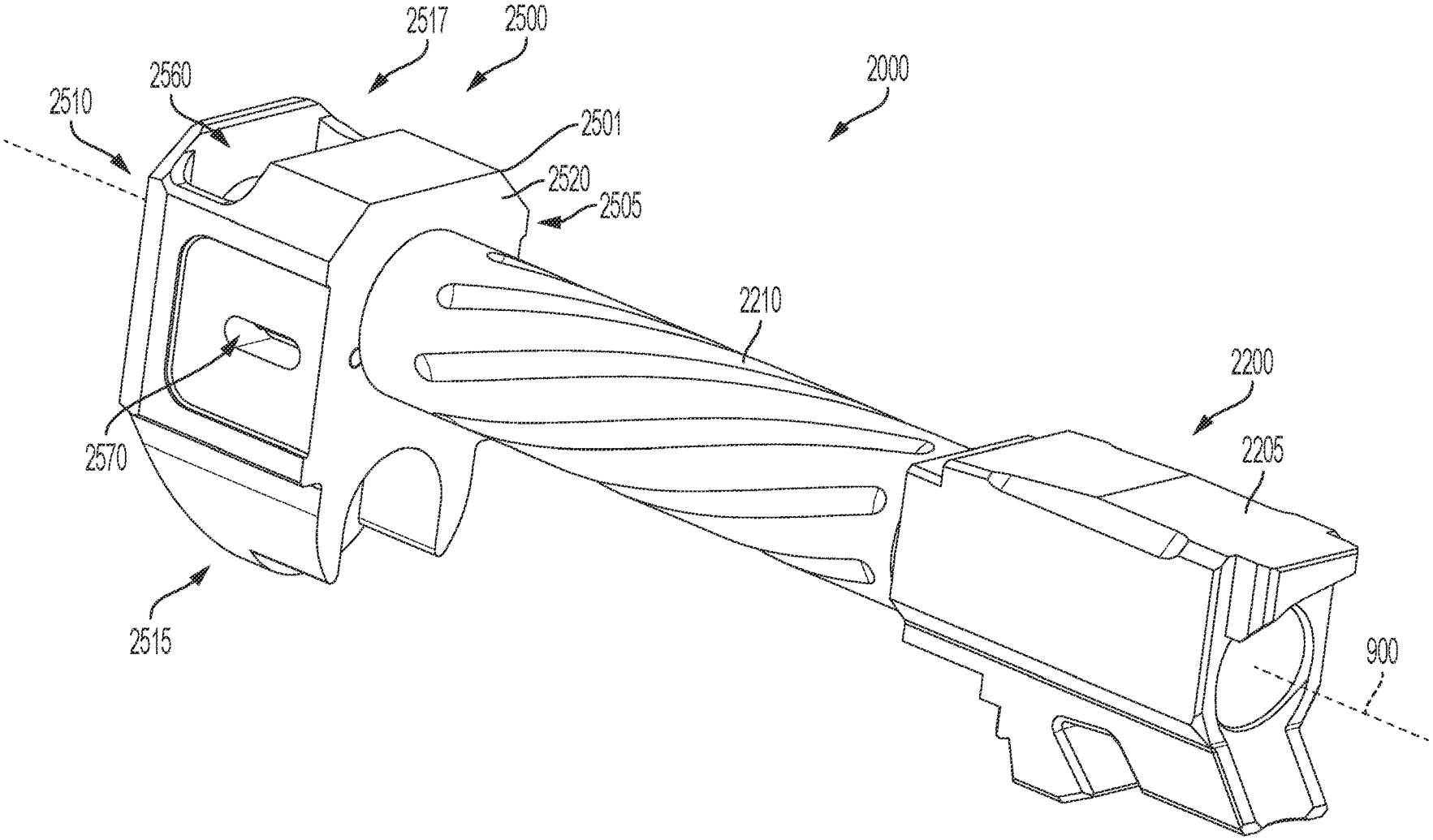
FIG. 19 is a perspective view of still another muzzle accessory assembly in accordance with an exemplary embodiment of the subject disclosure.

Head 1720 of main body 1700 is slidably positioned within blind slot 1630 of lock 1600, such that lock 1600 is rotatable with respect to main body 1700 about axis of rotation 900 between an unlocked position, at which pin 1800 engages with pin stop 1696 (see FIG. 17), and a locked position, at which pin 1800 engages with resting surface 1697 and stopping surface 1717 of side wall 1715*b* engages with the lower side of proximal wall 1620 to prevent over rotation of lock 1600 past the locked position (see FIG. 16). In the unlocked position, lobe-shaped slots 1650*a*, 1650*b*, 1650*c* of lock 1600 align with lobe-shaped slots 1730*a*, 1730*b*, 1730*c* of main body 1700 to permit insertion of barrel 1200 (with correspondingly aligned lobe-shaped lugs 1235*a*, 1235*b*, 1235*c*) distally through keyed bore 1645 of lock 1600. Proximally-facing surface 1622 of wall 1620 engages with distally-facing annular face 1225 of barrel 1200 to prevent over-insertion of barrel 1200 and ensure proper longitudinal alignment of barrel 1200 with respect to quick-connect muzzle accessory 1500. After barrel 1200 is fully inserted, lock 1600 is rotated by hand about axis of rotation 900 to the locked position, thereby causing lobe-shaped slots 1650*a*, 1650*b*, 1650*c* to come out of alignment with slots 1730*a*, 1730*b*, 1730*c* of main body 1700. In this position, the distally facing side of proximal wall 1620 engages with the proximally facing sides of lugs 1235*a*, 1235*b*, 1235*c* to firmly lock barrel 1200 longitudinally within quick-connect muzzle accessory 1500. In the locked position, resting surface 1697 engages with pin 1800 to maintain lock 1600 in the locked position and prevent inadvertent unlocking due to, for example, firearm discharge forces, droppage or entanglement with environmental objects. In the locked position, ball tip 1905 of biased stop assembly 1900 engages with laterally directed face 1712 of main body 1700 to provide a secondary mechanism for preventing inadvertent rotation of lock 1600 into the unlocked position. It should be appreciated, however, that either or both of resting surface 1697 and biased stop assembly 1900 may be employed and/or other structures/mechanisms for preventing inadvertent unlocking of lock 1600, and that various embodiments of the subject disclosure are not intended to be limited to any particular mechanism (s) for preventing inadvertent unlocking of lock 1600.

Similar to lock 500, spirally-extending guide slot 1680 of lock 1600 is structured such that a linear distance from axis of rotation 900 to lower slot surface 1690 decreases gradually from a position immediately adjacent pin stop 1696 to resting surface 1697. In this manner, as lock 1600 is rotated to the locked position, pin 1800 engages lower slot surface 1690 with increasing friction, causing biasing tab 1685 to displace slightly laterally (with greatest lateral displacement occurring in the locked position when pin 1800 engages with resting surface 1697). This, in turn, causes lock 1600 to exert an opposing force on barrel 1200 to engage annular slot 1220 of barrel 1200 firmly against the inside surface of keyed receptacle 1725 of main body 1700. In this manner, barrel 1200 is locked and maintained firmly via friction, thereby eliminating any rotational play of muzzle accessory 1500 about barrel 1200 that may result, for example, from design tolerances, wear and tear of contact surfaces, etc.

Referring now to FIGS. 19-23, there is shown still another exemplary quick-connect muzzle accessory assembly 2000 in accordance with an exemplary embodiment of the subject disclosure. Muzzle accessory assembly 2000 includes a firearm barrel 2200 having a proximal chamber 2205 for receiving a firearm round and a rifled firing tube 2210 extending distally from chamber 2205 and having a coupling 2215 at a distal end thereof, and a quick-connect muzzle accessory 2500 releasably coupled to the distal end of firing tube 2210 via coupling 2215. In the embodiment depicted in FIGS. 19-23, barrel 2200 is a handgun barrel configured for coupling to handgun slide 1000, though it should be appreciated that barrel 2200 and accessory 2500 may be shaped and sized differently to fit any type of firearm, such as, for example, a rifle or a shotgun.

Figure 20:
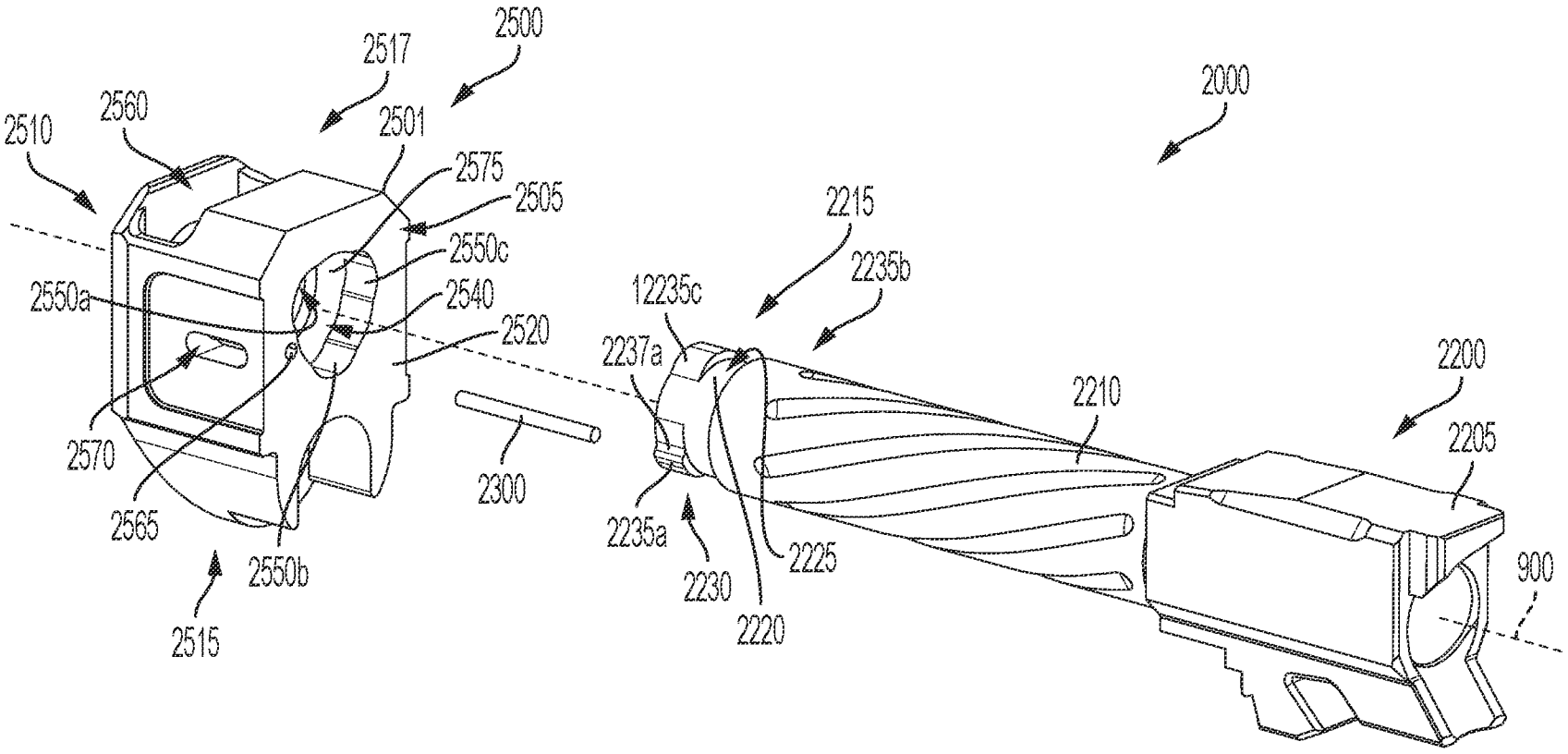
FIG. 20 is an exploded perspective view of the muzzle accessory assembly of FIG. 19.
Figure 21:
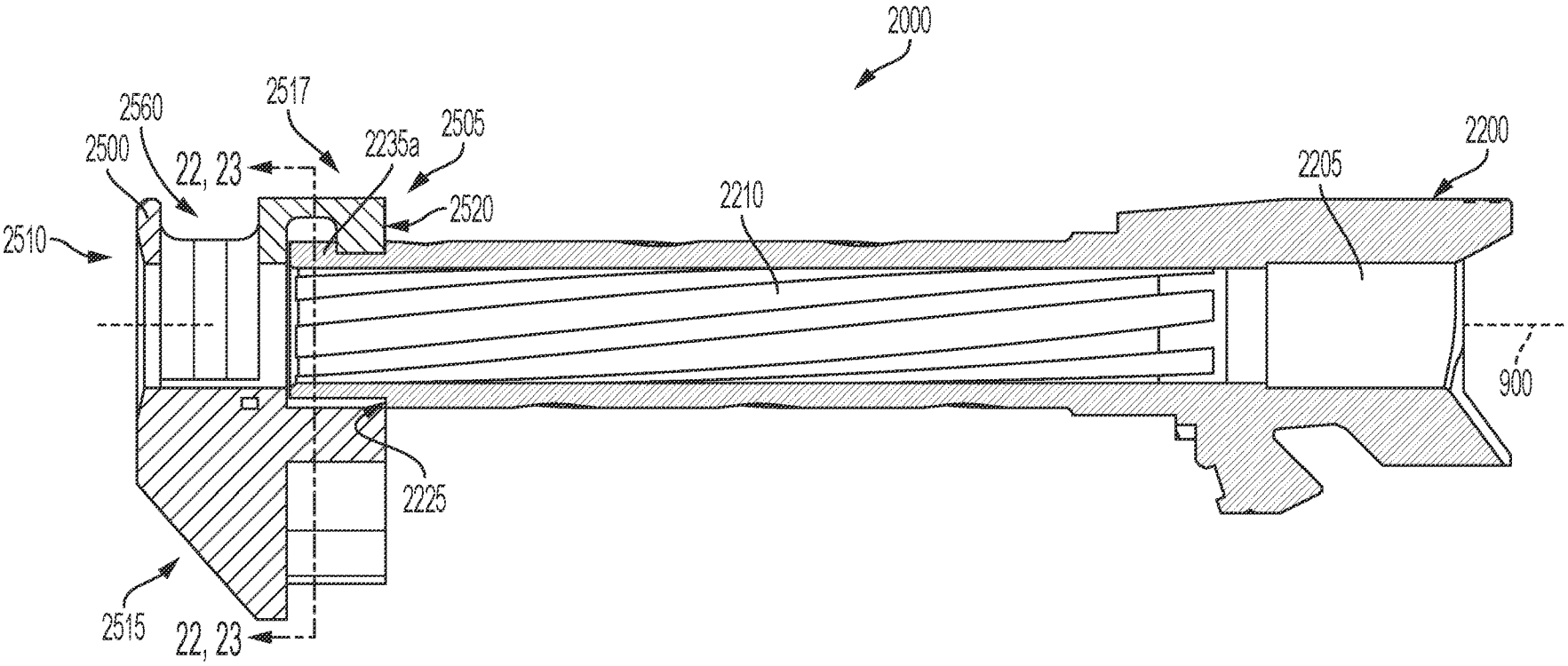
FIG. 21 is a side sectional view of the muzzle accessory assembly of FIG. 19.

As best shown in FIG. 20, coupling 2215 of barrel 1200 includes a key 2230 having three radially extending lobe-shaped lugs 2235*a*, 2235*b*, 2235*c* spaced 120 degrees apart circumferentially, and an annular slot 2220 proximal of key 2230 and forming a distally-facing annular face 2225. As described more fully below, key 2230 with lugs 2235*a*, 2235*b*, 2235*c* is shaped to mate closely with a corresponding keyed receptacle 2545 of quick-connect muzzle accessory 2500. For this purpose, it should be appreciated that key 2230 of barrel 2200 may include more or less than three lugs 2235 and lugs 2235 may be sized and shaped differently from one another to accommodate a differently sized and shaped keyed receptacle 2545. It should also be appreciated that lugs 2235 may be spaced at any orientation circumferentially about the outer surface of barrel 2200, and that various embodiments of the subject disclosure are not intended to be limited to any particular number, size, shape or circumferential spacing of lugs 2235.

Quick-connect muzzle accessory 2500 includes a main body 2501 having a proximal end 2505, a distal end 2510, a lower end 2515, an upper end 2517, a proximally-facing surface 2520, a through-channel 2540 extending longitudinally through main body 2501 from surface 2520 to distal end 2510, a keyed receptacle 2545 having three radially extending lobe-shaped slots 2550*a*, 2550*b*, 2550*c* spaced 120 degrees apart circumferentially about through-channel 2540 for receiving lugs 2235*a*, 2235*b*, 2235*c* of barrel 2200, a transverse and upwardly facing vent 2560 communicating with through-channel 2540 at distal end 2510, a detent spring 2300, a detent spring receipt bore 2565 for fixedly receiving detent spring 2300, a laterally extending window 2570 adjacent detent spring 2300, and an internal receptacle 2575 having a lower stopping surface 2580*a* and an upper stopping surface 2580*b*. Although the embodiment depicted in FIGS. 19-23 includes three lobe-shaped slots 2550*a*, 2550*b*, 2550*c* positioned to receive lugs 2235*a*, 2235*b*, 2235*c* of barrel 2200, it should be appreciated that any number of slots 2550 may be provided to match the number, position, shape and size of lugs 2235, and that various embodiments of the subject disclosure are not intended to be limited to any particular number, position, shape or size of slots 2550.

To attach muzzle accessory 2500 to barrel 2200, muzzle accessory 2500 is first rotated counterclockwise about longitudinal axis 900 (when viewed distally from the proximal end of muzzle accessory assembly 2000) until lobe-shaped slots 2550*a*, 2550*b*, 2550*c* respectively align with lugs 2235*a*, 2235*b*, 2235*c* of barrel 2200. Barrel 2200 is then inserted longitudinally into through-channel 2540 until lugs 2235*a*, 2235*b*, 2235*c* enter internal receptacle 2575 and annular face 2225 abuts proximally-facing surface 2520 of muzzle accessory 2500. Muzzle accessory 2500 is then rotated clockwise into its proper orientation to lock muzzle accessory 2500 to barrel 2200 (see FIGS. 22-23). As muzzle accessory 2500 is rotated clockwise, detent spring 2300 engages leading edge 2236*a* of lug 2235*a*, causing detent spring 2300 to displace laterally into window 2570. After full rotation of muzzle accessory 2500 into its proper orientation (see FIG. 23), detent spring 2300 snaps back into its original position adjacent trailing edge 2237*a* of lug 2235*a*. In this position, detent spring 2300 prevents inadvertent free counterclockwise rotation of muzzle accessory 2500 with respect to barrel 2200, while lower and upper stopping surfaces 2580*a*, 2580*b* engage with lugs 2235*a*, 2235*c*, respectively, to prevent clockwise rotation of muzzle accessory 2500.

To remove barrel 2200 from muzzle accessory 2500, muzzle accessory 2500 is rotated counterclockwise against the biasing force of detent spring 2300. Application of sufficient rotational force in the counterclockwise direction causes trailing edge 2237*a* of lug 2235*a* to engage and displace detent spring 2300 laterally into window 2560. Counterclockwise rotation of barrel 2200 continues until lugs 2235*a*, 2235*b*, 2235*c* respectively align with lobe-shaped slots 2550*a*, 2550*b*, 2550*c* of muzzle accessory 2500. Barrel 2200 is then removed longitudinally from muzzle accessory 2500.

Figure 22:
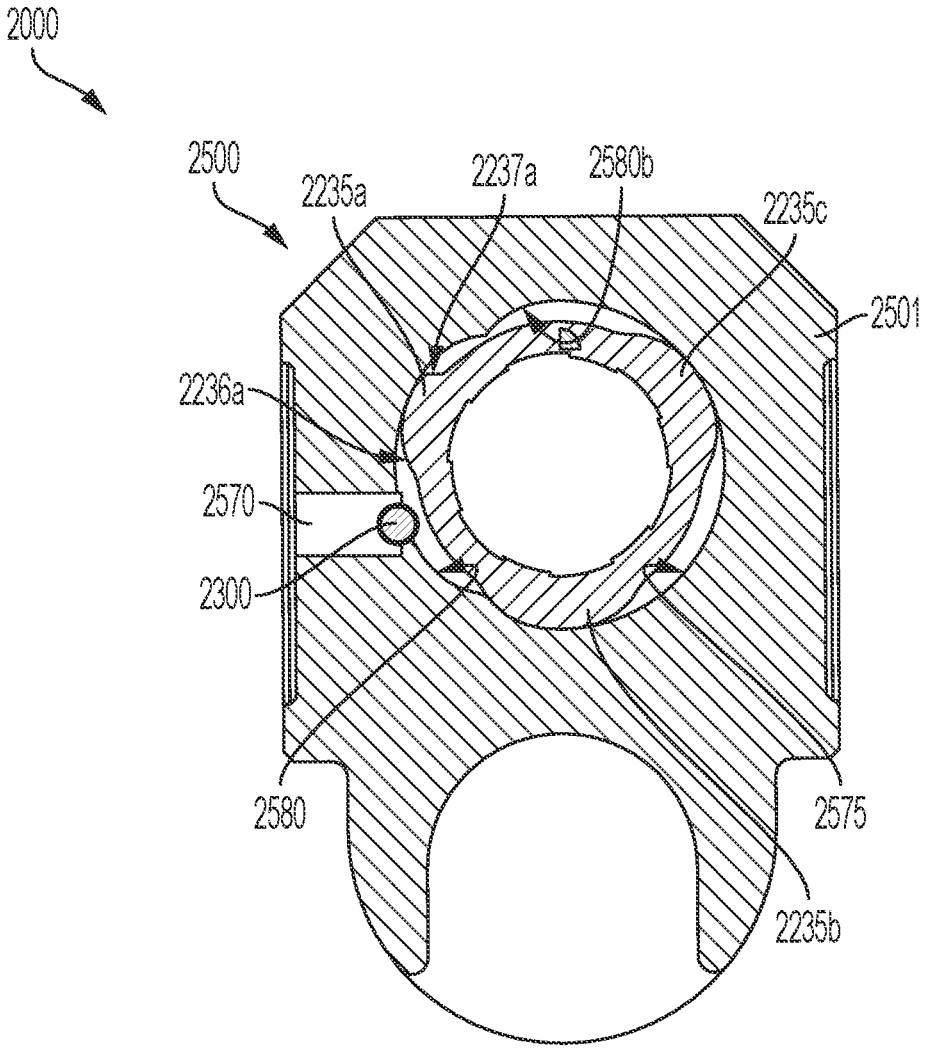
FIG. 22 is a distally-facing sectional view of the muzzle accessory assembly of FIG. 19 in an unlocked position.
Figure 23:
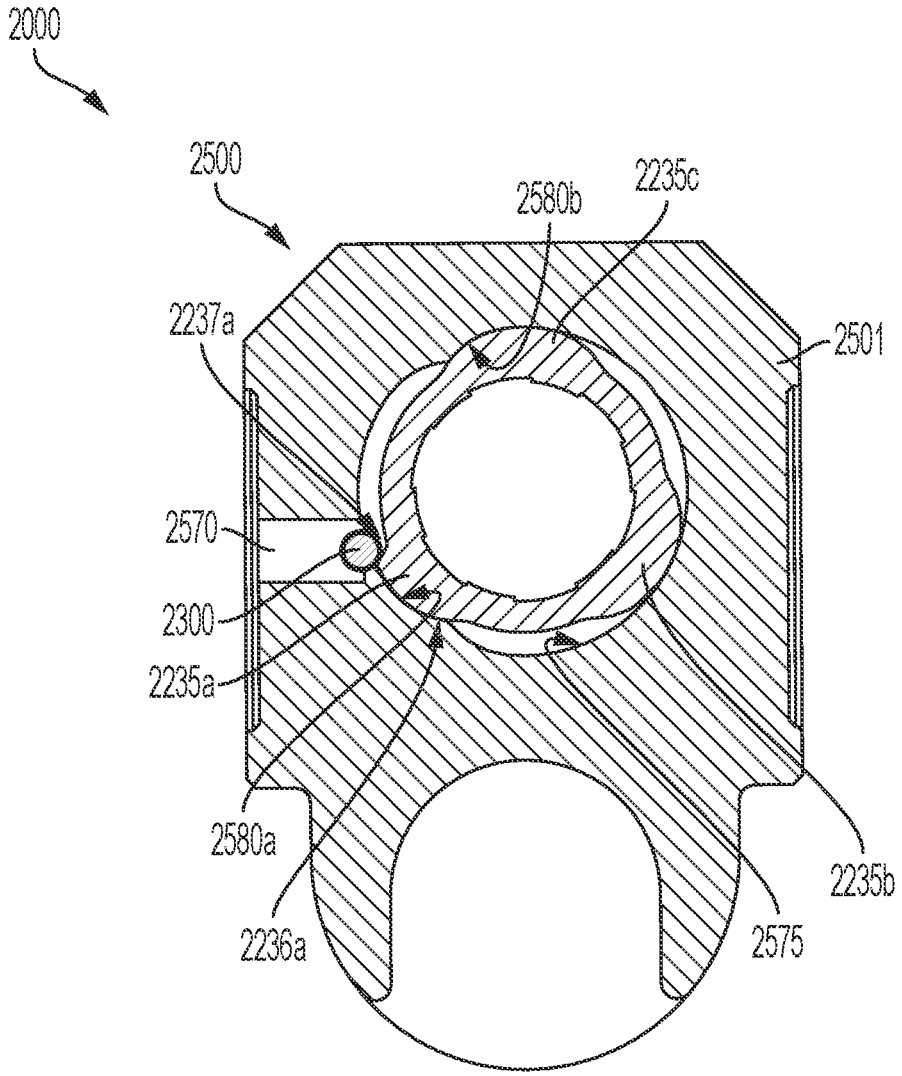
FIG. 23 is a distally-facing sectional view of the muzzle accessory assembly of FIG. 19 in a locked position.

As shown in FIGS. 22-23, trailing edge 2237*a* of lug 2235*a* is steeper than leading edge 2236*a*. In one embodiment, trailing edge 2237*a* is sufficiently steep to prevent rotational forces produced during operation of a firearm from inadvertently rotating muzzle accessory 2500 with respect to barrel 2200, but not so steep as to prevent a user from applying rotational force (e.g., by hand) to intentionally unlock muzzle accessory 2500 from barrel 2200.

It should be appreciated by those skilled in the art that changes may be made to the exemplary embodiments described above without departing from the broad inventive concept thereof. It is to be understood, therefore, that this disclosure is not limited to the particular exemplary embodiments disclosed, but it is intended to cover modifications within the spirit and scope of the claims defined herein.

What is claimed is:

1. A muzzle accessory assembly, comprising:

a muzzle accessory, including:

a main body having a proximal end, a distal end, a through-channel extending longitudinally between the proximal end and the distal end, a keyed receptacle within the through-channel, and a slot, and a lock within the slot of the main body, the lock being positionable into an unlocked position and a locked position; and a firearm barrel within the through-channel of the main body, the firearm barrel having a chamber for receiving a firearm round, a firing tube extending distally from the chamber, and a coupling engaging the keyed receptacle of the main body, wherein the firearm barrel is removable from the through-channel of the main body when the lock is in the unlocked position, and wherein the firearm barrel is locked longitudinally within the through-channel of the main body when the lock is in the locked position.

2. The muzzle accessory assembly of claim 1, wherein the muzzle accessory further includes a biased detent assembly configured to prevent the lock from being positioned into the unlocked position.

3. The muzzle accessory assembly of claim 1, wherein the firearm barrel is locked rotationally with respect to the main body when the lock is in the locked position.

4. The muzzle accessory assembly of claim 1, wherein the lock includes a head having a keyed bore, the keyed bore aligning with the keyed receptacle of the main body when the lock is in the unlocked position.

5. The muzzle accessory assembly of claim 4, wherein the coupling of the firearm barrel includes a plurality of lugs and the keyed receptacle of the main body includes a plurality of first slots respectively receiving the plurality of lugs.

6. The muzzle accessory assembly of claim 5, wherein the keyed bore of the lock includes a plurality of second slots respectively aligned with the first slots of the keyed receptacle when the lock is in the unlocked position.

7. The muzzle accessory assembly of claim 1, wherein the lock is rotatable within the main body about a longitudinal axis of rotation, the lock being rotatable between the unlocked position and the locked position.

8. The muzzle accessory assembly of claim 7, wherein the muzzle accessory further includes a pin and the lock further includes a spirally-extending slot having a lower surface and a pin stop, the pin engaging the pin stop in the unlocked position.

9. The muzzle accessory assembly of claim 8, wherein the lower surface of the spirally-extending slot includes a resting surface, the pin engaging the resting surface when the lock is in the locked position.

10. The muzzle accessory assembly of claim 9, wherein a distance from the axis of rotation to the lower surface of the spirally-extending slot decreases gradually from the pin stop to the resting surface.

11. The muzzle accessory assembly of claim 9, wherein the pin engages the lower surface of the spirally-extending slot with increasing friction as the lock is rotated from the unlocked position to the locked position.

12. A muzzle accessory for coupling to a firearm barrel, the firearm barrel including a chamber for receiving a firearm round, a firing tube extending distally from the chamber, and a coupling at a distal end of the firing tube, the muzzle accessory comprising:

a main body having a proximal end, a distal end, a through-channel extending longitudinally between the proximal end and the distal end, a keyed receptacle within the through-channel positioned to engage the coupling of the firearm barrel when the firearm barrel is inserted into the through-channel, and a slot; and a lock within the slot of the main body, the lock being positionable into an unlocked position to permit insertion of the barrel within the through-channel of the main body, the lock being further positionable into a locked position to prevent removal of the firearm barrel from the main body after the firearm barrel is inserted into the through-channel.

13. The muzzle accessory of claim 12, further comprising a biased detent assembly configured to prevent the lock from being positioned into the unlocked position.

14. The muzzle accessory of claim 12, wherein the lock includes a head having a keyed bore, the keyed bore aligning with the keyed receptacle of the main body when the lock is in the unlocked position.

15. The muzzle accessory of claim 12, wherein the coupling of the firearm barrel includes a plurality of lugs and the keyed receptacle of the main body includes a plurality of first slots structured to respectively receive the plurality of lugs when the firearm barrel is inserted into the through-channel of the main body.

16. The muzzle accessory of claim 15, wherein the keyed bore of the lock includes a plurality of second slots respectively aligned with the first slots of the keyed receptacle when the lock is in the unlocked position.

17. The muzzle accessory of claim 12, wherein the lock is rotatable within the main body about a longitudinal axis of rotation, the lock being rotatable between the unlocked position and the locked position.

18. The muzzle accessory of claim 17, further comprising a pin, the lock further including a spirally-extending slot having a lower surface and a pin stop, the pin engaging the pin stop in the unlocked position.

19. The muzzle accessory of claim 18, wherein the lower surface of the spirally-extending slot includes a resting surface, the pin engaging the resting surface when the lock is in the locked position.

20. The muzzle accessory of claim 19, wherein a distance from the axis of rotation to the lower surface of the spirally-extending slot decreases gradually from the pin stop to the resting surface.

21. The muzzle accessory of claim 19, wherein the pin engages the lower surface of the spirally-extending slot with increasing friction as the lock is rotated from the unlocked position to the locked position.

22. A muzzle accessory for coupling to a firearm barrel, the muzzle accessory comprising:

a main body having a proximal end, a distal end, a through-channel extending longitudinally between the proximal end and the distal end, a keyed receptacle within the through-channel, and a slot; and a lock within the slot of the main body, the lock having a keyed bore, the lock being positionable into an unlocked position and a locked position, wherein the keyed bore aligns with the keyed receptacle of the main body when the lock is in the unlocked position, and the keyed bore does not align with the keyed receptacle of the main body when the lock is in the locked position.

23. The muzzle accessory of claim 22, wherein the keyed receptacle of the main body includes a plurality of first slots and the keyed bore of the lock includes a plurality of second slots, the second slights respectively aligning with the first slots when the lock is in the unlocked position.

24. The muzzle accessory of claim 22, wherein the lock is rotatable within the main body about a longitudinal axis of rotation, the lock being rotatable between the unlocked position and the locked position.

25. The muzzle accessory of claim 24, further comprising a pin, the lock further including a spirally-extending slot having a lower surface and a pin stop, the pin engaging the pin stop in the unlocked position.

26. The muzzle accessory of claim 25, wherein the lower surface of the spirally-extending slot includes a resting surface, the pin engaging the resting surface when the lock is in the locked position.

27. The muzzle accessory of claim 26, wherein a distance from the axis of rotation to the lower surface of the spirally-extending slot decreases gradually from the pin stop to the resting surface.

28. The muzzle accessory of claim 26, wherein the pin engages the lower surface of the spirally-extending slot with increasing friction as the lock is rotated from the unlocked position to the locked position.

29. The muzzle accessory of claim 22, further comprising a biased detent assembly configured to prevent the lock from being positioned into the unlocked position.

30. The muzzle accessory of claim 22, wherein the main body forms a compensator.

* * * * *